US007934574B2

(12) United States Patent
Seino

(10) Patent No.: US 7,934,574 B2
(45) Date of Patent: May 3, 2011

(54) SWING WORKING VEHICLE

(75) Inventor: Hideki Seino, Chikugo (JP)

(73) Assignee: Yanmar Co., Ltd., Osaka-shi, Osaka (JP)

( * ) Notice: Subject to any disclaimer, the term of this patent is extended or adjusted under 35 U.S.C. 154(b) by 551 days.

(21) Appl. No.: 11/994,776

(22) PCT Filed: Jan. 19, 2006

(86) PCT No.: PCT/JP2006/300734

§ 371 (c)(1),
(2), (4) Date: May 7, 2008

(87) PCT Pub. No.: WO2007/004328

PCT Pub. Date: Jan. 11, 2007

(65) Prior Publication Data

US 2009/0078666 A1 Mar. 26, 2009

(30) Foreign Application Priority Data

Jul. 5, 2005 (JP) ..... 2005-196826

(51) Int. Cl.
*E02F 9/08* (2006.01)

(52) U.S. Cl. ..... 180/89.13; 280/781; 414/686

(58) Field of Classification Search ..... 414/686, 414/687; 280/760, 781; 180/89.1, 89.12, 180/89.13; *E02F 09/08*
See application file for complete search history.

(56) References Cited

U.S. PATENT DOCUMENTS 5,244,337 A * 9/1993 Stenger ..... 414/687

FOREIGN PATENT DOCUMENTS

| | | | |
|---|---|---|---|
| JP | 9-316929 | A * | 12/1997 |
| JP | 11-256615 | A * | 9/1999 |
| JP | 11-269916 | | 10/1999 |
| JP | 1999-269926 | | 10/1999 |
| JP | 1999-343636 | | 12/1999 |
| JP | 2001-11889 | A * | 1/2001 |
| JP | 2001-132016 | A * | 5/2001 |
| JP | 2001-254397 | | 9/2001 |
| JP | 2002-8808 | A * | 3/2002 |
| JP | 2002-129595 | | 5/2002 |
| JP | 2002 327459 | A | 11/2002 |
| JP | 2003-20681 | | 1/2003 |
| JP | 2003-64722 | A * | 3/2003 |
| JP | 2003-64724 | A * | 3/2003 |
| JP | 2003-336286 | A * | 11/2003 |
| JP | 2004-293258 | A * | 10/2004 |
| JP | 2005-2767 | | 1/2005 |
| JP | 2005-83040 | A * | 3/2005 |
| JP | 2005-133494 | A * | 5/2005 |

OTHER PUBLICATIONS

International Search Report for International Application No. PCT/JP2006/300734, Japanese Patent Office, mailed Mar. 14, 2006, 2 pgs.
Supplementary European Search Report for Application No. EP 06 71 1980, European Patent Office, mailed Jun. 15, 2009, 3 pgs.

* cited by examiner

*Primary Examiner* — Ruth Ilan
(74) *Attorney, Agent, or Firm* — Sterne, Kessler, Goldstein & Fox P.L.L.C.

(57) ABSTRACT

A rotation table frame for a working vehicle including, a portion rearward of both sides of the rotation table frame being substantially within a width of a traveling device and circular in a plan view, a front portion of the rotation table frame is rectilinearly cut in a left-right direction in the plan view, and the rotation table frame has a stepped portion formed at a right side relative to the advancement direction and recessed rearward.

2 Claims, 26 Drawing Sheets

SWING WORKING VEHICLE

BACKGROUND

1. Field

The present invention relates to swing working vehicles of a type having an extremely small swing radius at the rear and a type having an extremely small swing radius, and more particularly to a rotation table frame that is rotatably supported on a traveling device and attached with a working machine.

2. Background Art

Conventionally, in a swing working vehicle such as a power shovel, a rotation table frame is generally arranged on a traveling device; a working machine with attachments such as a boom, arm, and bucket is attached to a front portion of the rotation table frame; and an engine, counterweight, and the like are arranged on a rear portion of the rotation table frame. Also, the swing working vehicle is configured, based on a shape of the rotation table frame, as a type having an extremely small swing radius at the rear or a type having an extremely small swing radius, in which a swing radius is minimized.

The swing working vehicle of the type having an extremely small swing radius at the rear is configured such that a rear shape of the rotation table frame or the like is formed in an arc shape at an equal distance from a swing center, and a length twice as long as the swing radius of the rear end of the machine body is less than or equal to 120% of a vehicle width. In such a swing working vehicle, a front end of the machine body may project forward as compared with a swing radius of the rear end (see, for example, Patent document 1). On the other hand, the swing working vehicle of the type having an extremely small swing radius is configured such that a planar shape of the rotation table frame is close to a substantially circular shape, and an outermost swing radius of the machine body is equal to or less than a vehicle width (see, for example, Patent document 2). Also, some of the swing working vehicles of the type having an extremely small swing radius are configured such that a base portion of the working machine can be rotationally moved right and left (see, for example, Patent document 3).

In a conventional swing working vehicle as described above, a shape of the rotation table frame is different between the types having an extremely small swing radius at the rear and an extremely small swing radius, so that it has been necessary to manufacture the rotation table frame portion separately, which has been a factor that prevents an improvement in productivity and reduction in cost.

Patent document 1: Japanese Unexamined Patent Publication No. 1999-269926

Patent document 2: Japanese Unexamined Patent Publication No. 1999-343636

Patent document 3: Japanese Unexamined Patent Publication No. 2001-254397

BRIEF SUMMARY

Problems to be Solved by the Invention

A problem to be solved is that a rotation table frame that is rotatably supported on the traveling device and includes the working machine is made common to the swing working vehicles of the type having an extremely small swing radius at the rear and the type having an extremely small swing radius, whereby productivity is improved and cost is reduced.

Means Adapted to Solve the Problems

A rotation table frame of a swing working vehicle according to the present invention is adapted to be in a circular shape in a plan view from both side portions to a rear end thereof, wherein a left side to a left end of the rotation table frame and a right side to a right end of the rotation table frame in a front portion of the rotation table frame are substantially linearly cut off in a lateral direction in a plan view; the right side is adapted to be a stepped portion backwardly recessed as compared with the left side; and boom fulcrums are adapted to be able to be arranged both between the left side and the right side in the front portion of the rotation table frame in the lateral direction, and on the right side stepped portion, within a swing radius.

The swing working vehicle according to the present invention having the rotation table frame is configured such that the boom fulcrum is arranged between the left side and the right side in the front portion of the rotation table frame in the lateral direction, and a step for hiding the stepped portion is arranged on the stepped portion in the rotation table frame so as to be positioned within the swing radius.

The rotation table frame of the swing working vehicle according to the present invention is adapted to be able to support a hydraulic cylinder rearward of the right side stepped portion.

The swing working vehicle according to the present invention having the rotation table frame is configured such that a fuel tank and a radiator are longitudinally arranged above the hydraulic cylinder supported rearward of the right side stepped portion in the rotation table frame, and an engine and a reservoir tank are installed together lateral to the radiator.

The swing working vehicle according to the present invention having the rotation table frame is configured such that a boom fulcrum is arranged on the right side stepped portion in the rotation table frame, and the hydraulic cylinder is adapted to be a boom cylinder.

EFFECT OF THE INVENTION

Because the rotation table frame of the swing working vehicle according to the present invention is adapted to be in a circular shape in a plan view from both side portions to a rear end thereof, wherein a left side to a left end of the rotation table frame and a right side to a right end of the rotation table frame in a front portion of the rotation table frame are substantially rectilinearly cut off in a lateral direction in a plan view; the right side is adapted to be a backwardly recessed stepped portion as compared with the left side; and boom fulcrums are adapted to be able to be arranged both between the left side and the right side in the front portion of the rotation table frame in the lateral direction, and on the right side stepped portion, within a swing radius, the swing working vehicle of the type having an extremely small swing radius at the rear can be configured by arranging a boom bracket as the boom fulcrum between the left side and the right side in the front portion of the rotation table frame in the lateral direction of the front portion of the rotation table frame, and the swing working vehicle of the type having an extremely small swing radius can also be configured by arranging the boom fulcrum on the stepped portion, so that it becomes possible to form the rotation table frame in a shape common to the both. For this reason, a molding die for the rotation table frame can be made common, resulting in an improvement in productivity and reduction in cost. Also, when the boom fulcrum is arranged on the right side stepped portion in the rotation table frame within the swing radius to configure the swing working vehicle of the type having an extremely small swing radius, a space within a driving operation portion can be made larger than that within a conventional one, and therefore habitability can be improved.

The swing working vehicle according to the present invention having the rotation table frame is configured such that the boom fulcrum is arranged between the left side and the right side in the front portion of the rotation table frame in the lateral direction, and a step for hiding the stepped portion is arranged on the stepped portion in the rotation table frame so as to be positioned within the swing radius, so that in the swing working vehicle of the type having an extremely small swing radius at the rear, a walk-through space that is laterally through can be formed, and therefore a workable range can be expanded to thereby improve workability. Also, maintenance can be easily performed if the step is removed.

The rotation table frame of the swing working vehicle according to the present invention is adapted to be able to support a hydraulic cylinder rearward of the right side stepped portion, so that in the swing working vehicle having the rotation table frame, the hydraulic cylinder can be stored in the rotation table frame.

The swing working vehicle according to the present invention having the rotation table frame is configured such that a fuel tank and a radiator are longitudinally arranged above the hydraulic cylinder supported rearward of the right side stepped portion in the rotation table frame, and an engine and a reservoir tank are installed together lateral to the radiator, so that various instruments can be effectively arranged on the rotation table frame in common to the swing working vehicles of the type having an extremely small swing radius at the rear and the type having an extremely small swing radius.

The swing working vehicle according to the present invention having the rotation table configured such that the boom fulcrum is arranged on the right side stepped portion in the rotation table frame, and the hydraulic cylinder is adapted to be a boom cylinder, so that the boom cylinder is consequently stored in the rotation table frame, and therefore the working machine can be configured to be light in weight and compact.

DETAILED DESCRIPTION

Figure 1:
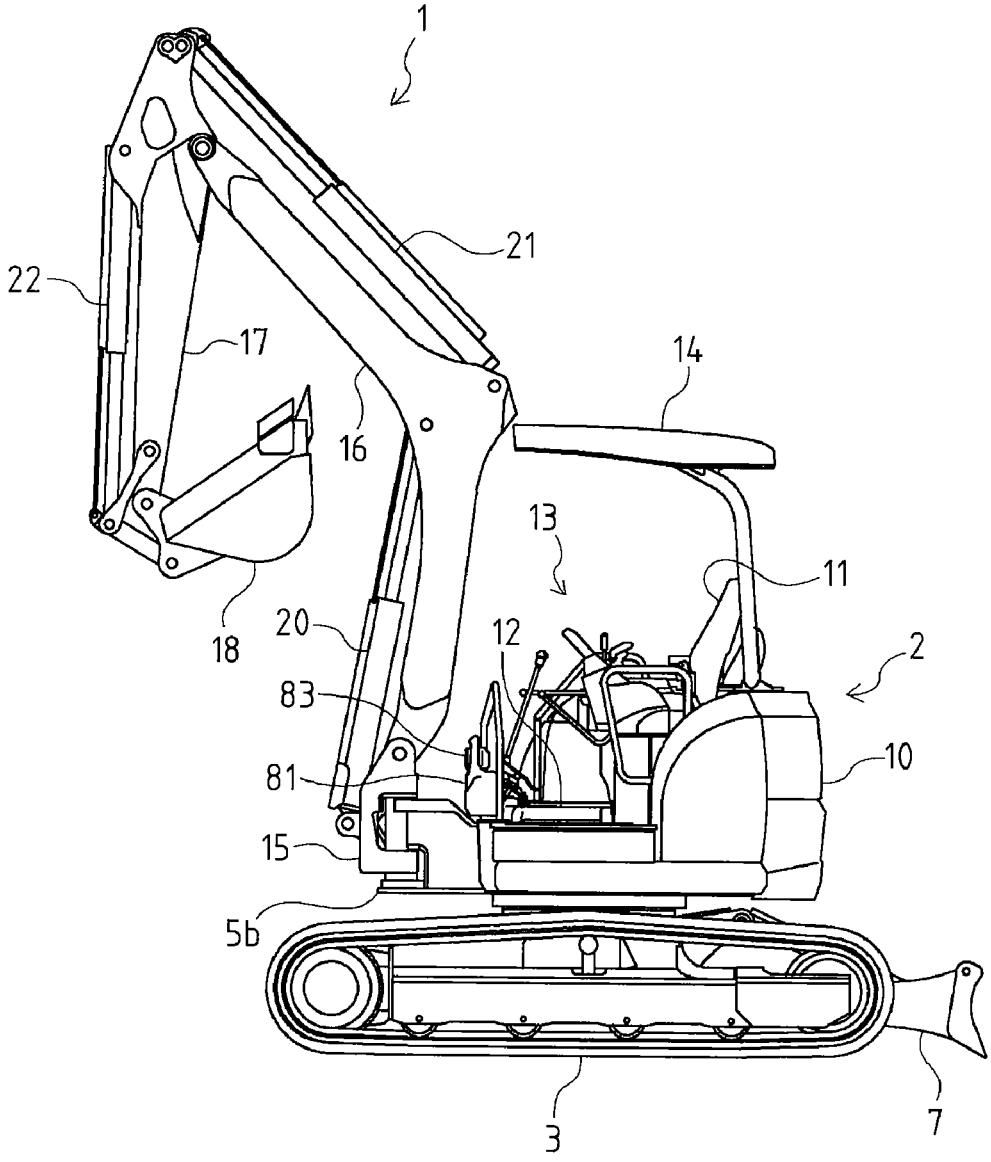
FIG. 1 is a left side view of the swing working vehicle of the type having an extremely small swing radius at the rear according to one embodiment of the present invention.
Figure 2:
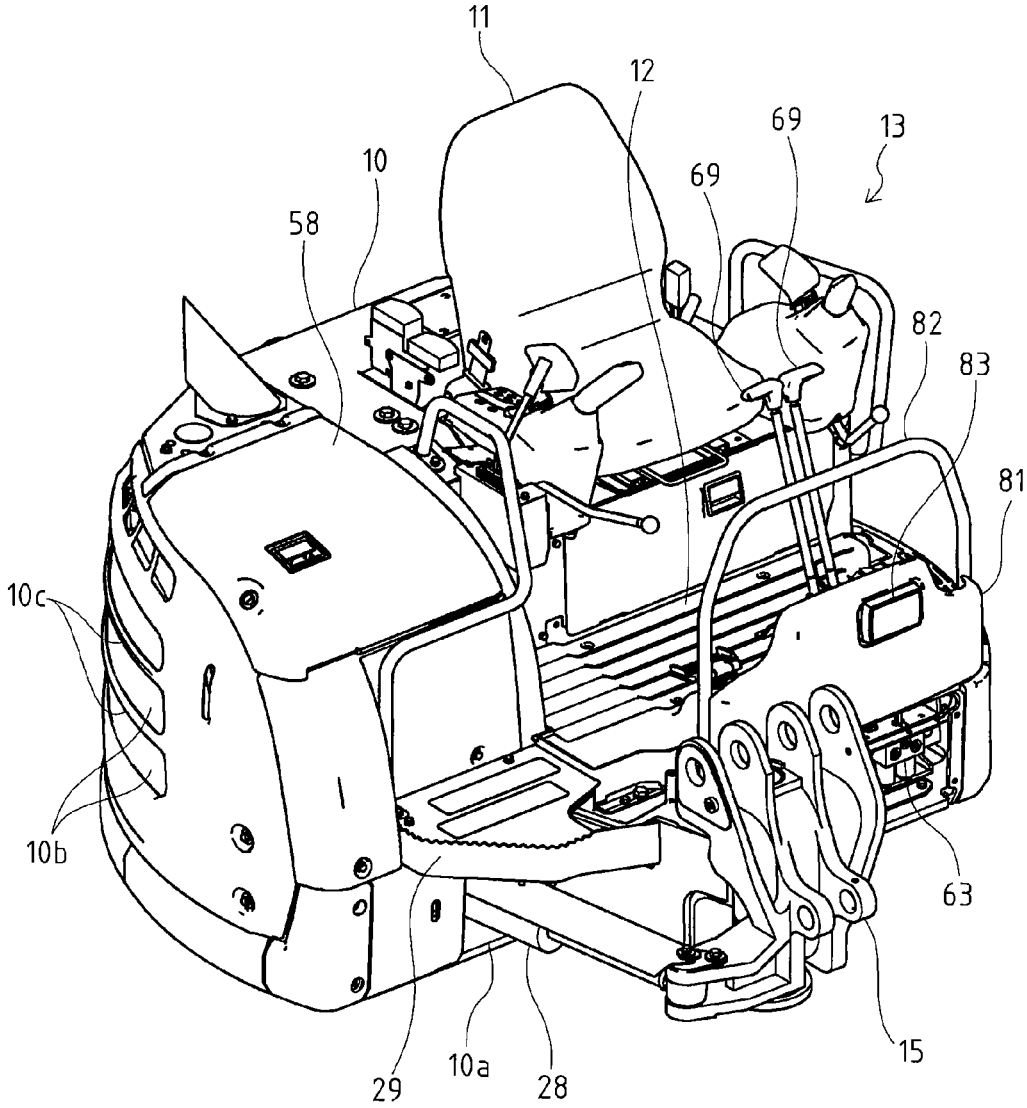
FIG. 2 is a perspective view of the main machine in the swing working vehicle.
Figure 3:
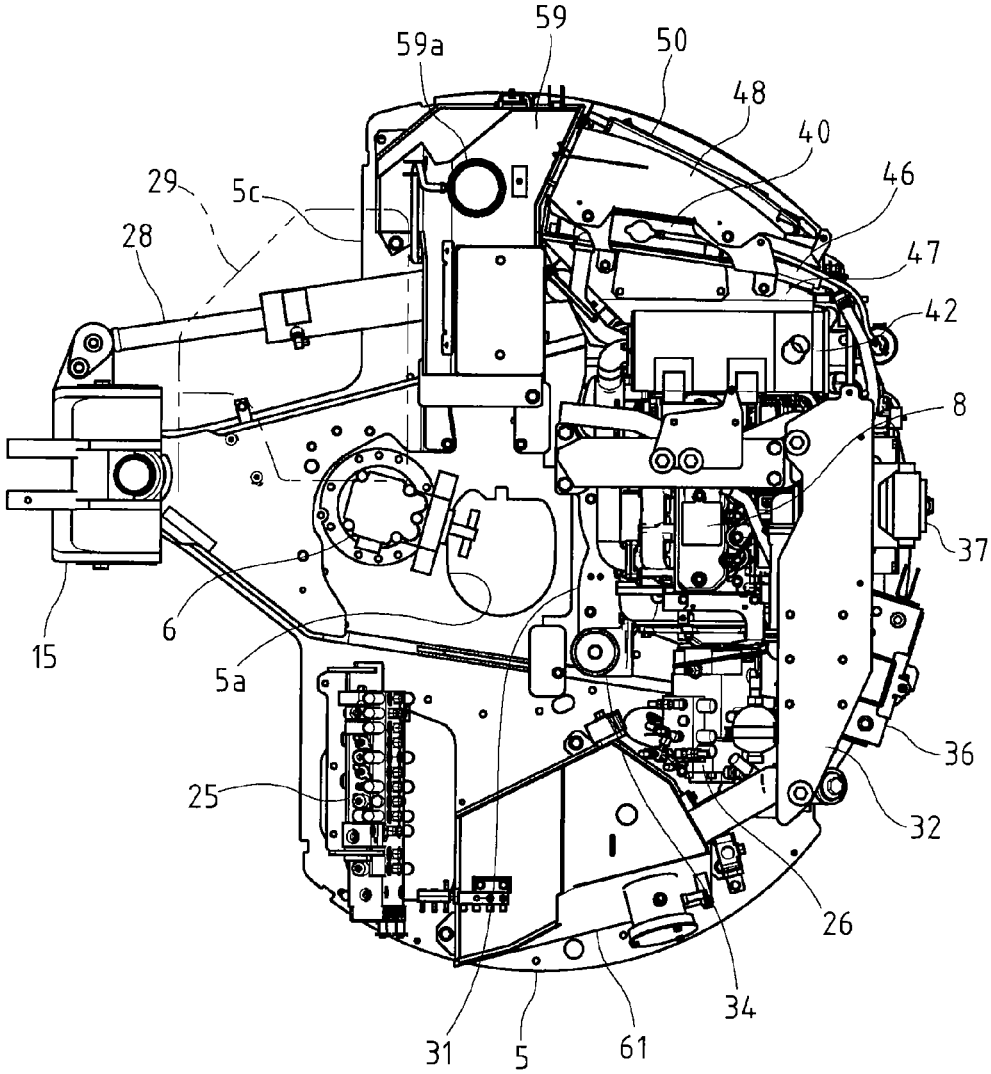
FIG. 3 is a plan view illustrating a configuration on the rotation table frame.
Figure 4:
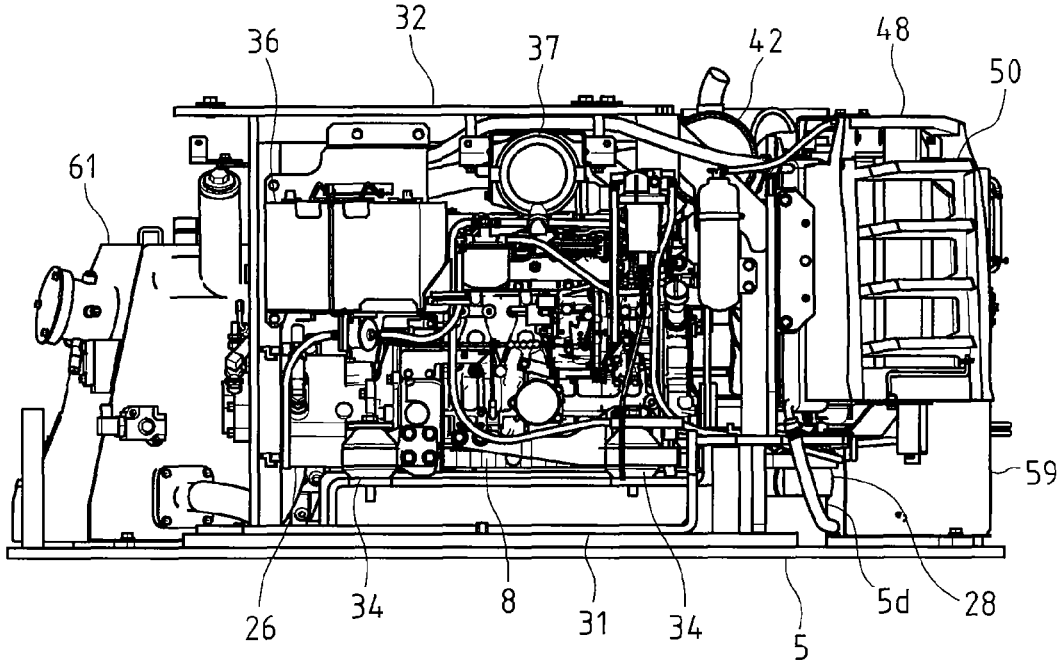
FIG. 4 is a rear view illustrating the configuration on the rotation table frame.
Figure 5:
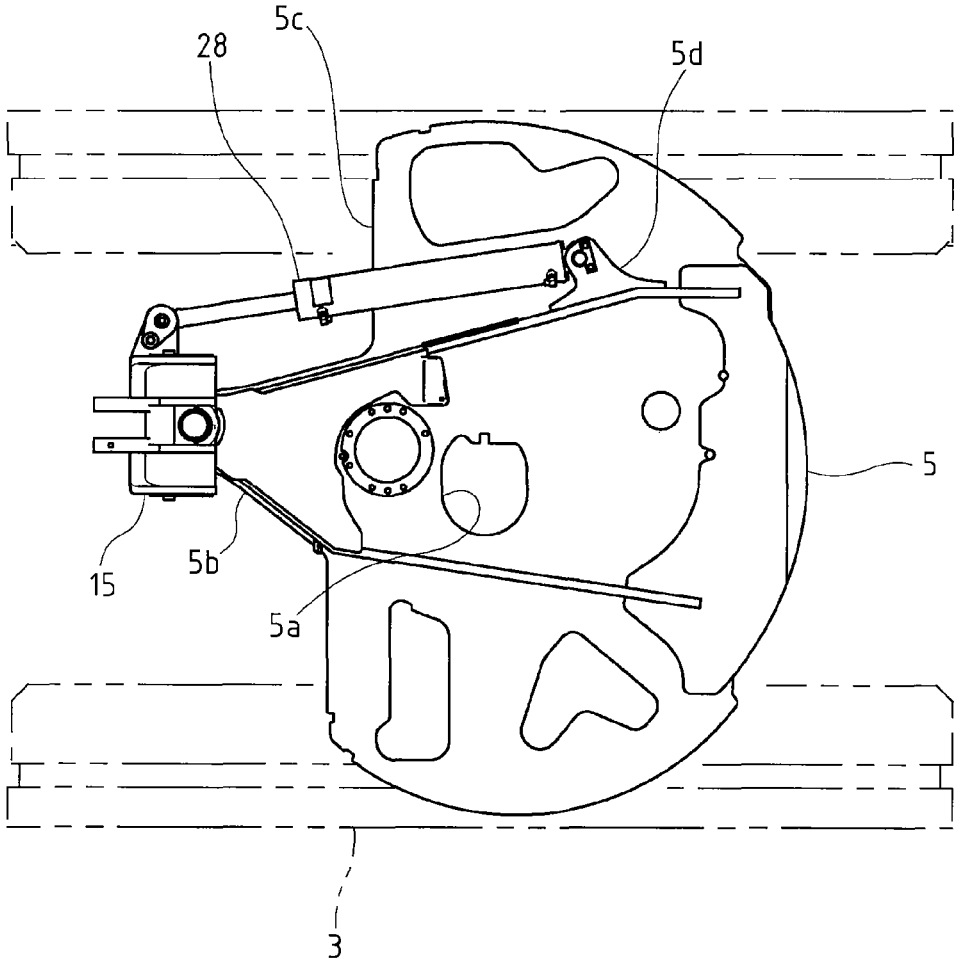
FIG. 5 is a plan view of the rotation table frame.
Figure 6:
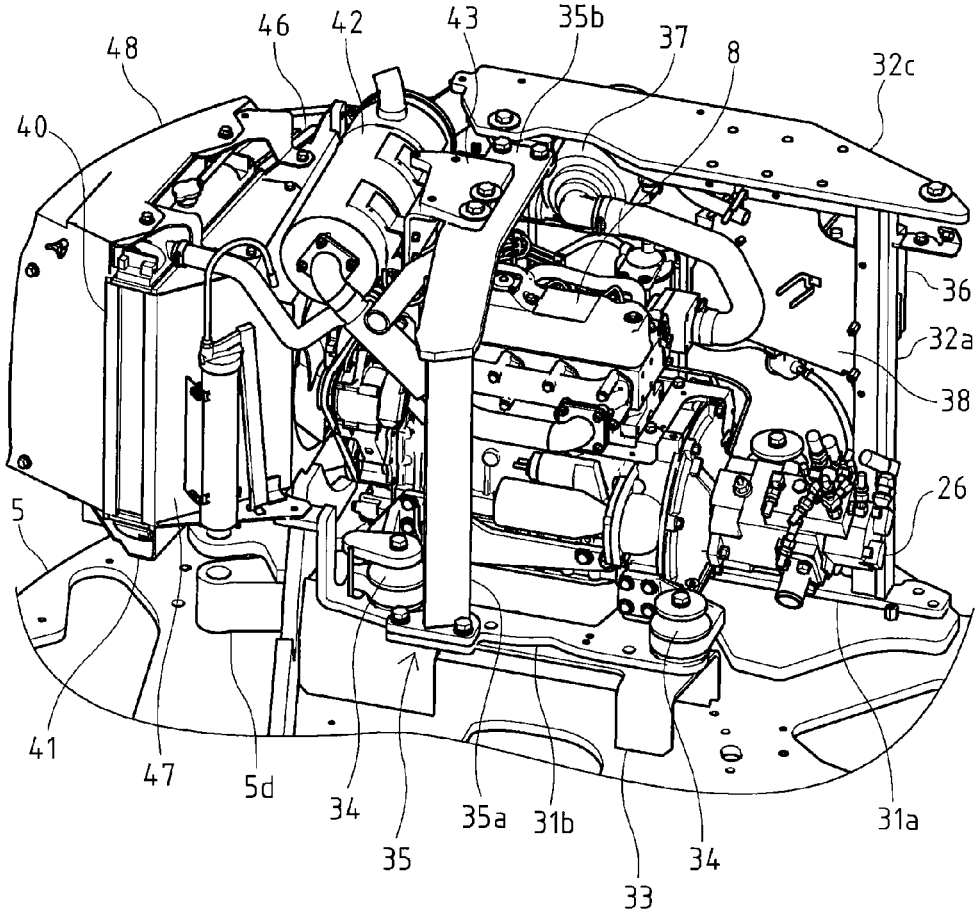
FIG. 6 is a front perspective view of an engine supporting portion.

As illustrated in FIGS. 1, 2, and 3, in the swing working vehicle such as a power shovel of a type having an extremely small swing radius at the rear in which a working machine 1 is attached to a lateral center of a front portion of a main machine 2, a rotation table frame 5 is supported on an upper center of a crawler type traveling device 3 via a rotation table bearing so as to be rotatable right and left, and a rotation motor 6 is arranged on the rotation table frame 5. On one of a front or rear side of the crawler type traveling device 3, a blade 7 is placed so as to rotatably move up and down. On an upper portion of the rotation table frame 5, a hood 10 covering an engine 8 and the like is placed, and on the hood 10 or on a front side of the hood 10, a driver's seat 11 is arranged. Also, an operating lever, lock lever, and the like are arranged near the driver's seat 11, and a traveling lever, pedal, and the like are arranged on a step 12 in front of the driver's seat 11 to thereby configure a driving operation portion 13. Further, above the driving operation portion 13, a canopy 14 or a cabin is placed.

Still further, a boom bracket 15 is attached to a lateral center of a front end of the rotation table frame 5 so as to be able to rotationally move right and left, and a lower end portion of a boom 16 is supported by the boom bracket 15 so as to be able to rotationally move up and down (back and forth). The boom 16 is bent forward in its middle portion, and thereby formed in a substantially dogleg shape in a side view. Also, a rear end portion of an arm 17 is supported by an upper end portion of the boom 16 so as to be able to rotationally move back and forth, and a bucket 18, which is an attachment for working, is supported by a top of the arm 17 so as to be able to rotationally move back and forth. Further, a boom cylinder 20 for rotationally moving the boom 16 is set between a front portion of the boom bracket 15 and a front portion of the middle portion of the boom 16; an arm cylinder 21 for rotationally moving the arm 17 is set between a rear face of the middle portion of the boom 16 and a stay provided in the rear end portion of the arm 17; and a bucket cylinder 22 for rotationally moving the bucket 18 is set between the stay in the rear end portion of the arm 17 and the bucket 18. The working machine 1 includes such boom 16, arm 17, bucket 18, respective cylinders 20, 21, and 22, and the like.

In the working machine 1, the boom 16 is adapted to be able to rotationally move by extract/retract driving of the boom cylinder 20; the arm 17 is adapted to be able to rotationally move by extract/retract driving of the arm cylinder 21; and the bucket 18 is adapted to be able to rotationally move by extract/retract driving of the bucket cylinder 22. Also, in the main machine 2, the rotation table frame 5 on the crawler type traveling device 3 is adapted to be rotatable by rotational driving of the rotation motor 6. Such cylinders 20, 21, and 22, and rotation motor 6, which are hydraulic actuators, are configured to drive in such a way that a control valve 25 is switched by a rotational movement operation of the operating lever, pedal, or the like placed in the driving operation portion 13, and thereby pressure oil is fed from a hydraulic pump 26 placed on the rotation table frame 5 through a hydraulic hose.

As illustrated in FIGS. 2 to 5, in a longitudinal and lateral middle portion of the rotation table frame 5, an opening portion 5*a* for placing the rotation table bearing is provided, and a center of the opening portion 5*a* is adapted to be a rotational center of the main machine 2. An outer circumferential shape of the rear portion of the rotation table frame 5 is formed so as to be in a semicircular shape (substantially 3/5 circle) of which a center corresponds to the rotational center in a plan view, and a radius of the semicircular portion is adapted to be substantially equal to a radius of a swing trajectory of the rear portion of the rotation table frame 5. In other words, a distance from the rotational center to the arc portion is adapted to be equal to the radius of the substantially circular-shaped swing trajectory drawn by the rear portion of the rotation table frame. Also, the rotation table frame 5 is adapted to substantially correspond to the crawler type traveling device 3 in terms of a lateral width, and is configured to be rotatable on the crawler type traveling device 3 by driving of the rotation motor 6 provided near the opening portion 5*a*.

Further, the front portion of the rotation table frame 5 is rectilinearly cut off, and thereby an outer circumferential shape of the front portion is linearly formed. In a laterally middle portion of the linear portion, a boom bracket attaching portion 5*b* that is configured in a substantially triangular shape in a plan view and intended for attaching the boom bracket 15 is provided so as to project forward, and in a front portion of the boom bracket attaching portion 5*b*, the boom bracket 15 for attaching the working machine 1 is arranged so as to be positioned within the swing radius. Further, the driving operation portion 13 is arranged on a left side portion of the rotation table frame 5, while on a right side portion and rear portion, the hood 10 is arranged along the outer circumferential shape of the rotation table frame 5, in which the engine 8, the hydraulic pump 26, the fuel tank, the hydraulic oil tank, the radiator, and the like are contained.

Still further, on one of a right or left side of the front portion of the rotation table frame 5, in this embodiment, a backwardly recessed stepped portion 5*c* is provided on the right side that is a side laterally opposite to the driving operation portion 13. A front face of the stepped portion 5*c* is extended in the lateral direction. Above the front face of the stepped portion 5*c*, an opening portion 10*a* is provided, and a swing cylinder 28 is provided so as to project from the opening portion 10*a* toward the boom bracket 15. The swing cylinder 28 is pivotally supported at its rear end by a pivotally supporting portion 5*d* provided on the rotation table frame 5 so as to be able to rotationally move, while a top thereof is connected to the boom bracket 15, and configured to be able to rotationally move the boom bracket 15 right and left relative to the rotation table frame 5 by extract/retract driving thereof.

Still further, above the stepped portion 5*c* of the rotation table frame 5, a second step 29 is provided so as to hide the stepped portion 5*c* and an opening portion 10*a*; cover a front portion of a cylinder tube of the swing cylinder 28; and be positioned within the swing radius. The second step 29 is removably fixed to a front portion of the hood 10 as a substantially triangular shape in a plan view, and is arranged so as to continuously correspond to the step 12 provided in the front portion of the driving operation portion 13 in the lateral direction in terms of heights of their upper faces. In this manner, a walk-through space that is laterally through is formed above the step 12 and the second step 29, and due to the walk-through space, a workable range on the main machine 2 is expanded to thereby improve workability. Also, hydraulic hoses are extended together from the opening portion 10*a* provided below the second step 29 toward the respective cylinders 20, 21, and 22 provided in the working machine 1, and maintenance can be easily performed if the second step 29 is removed.

Still further, as also illustrated in FIGS. 6 to 9, on a portion of the rotation table frame 5, which is covered by the hood 10, a supporting body integrally including an engine supporting member 31 for supporting the engine 8 laterally arranged on the rotation table frame 5 and a canopy attaching member 32 for attaching canopy 14 is securely arranged. The supporting body is configured in a substantially L-shape in a side view.

Figure 9:
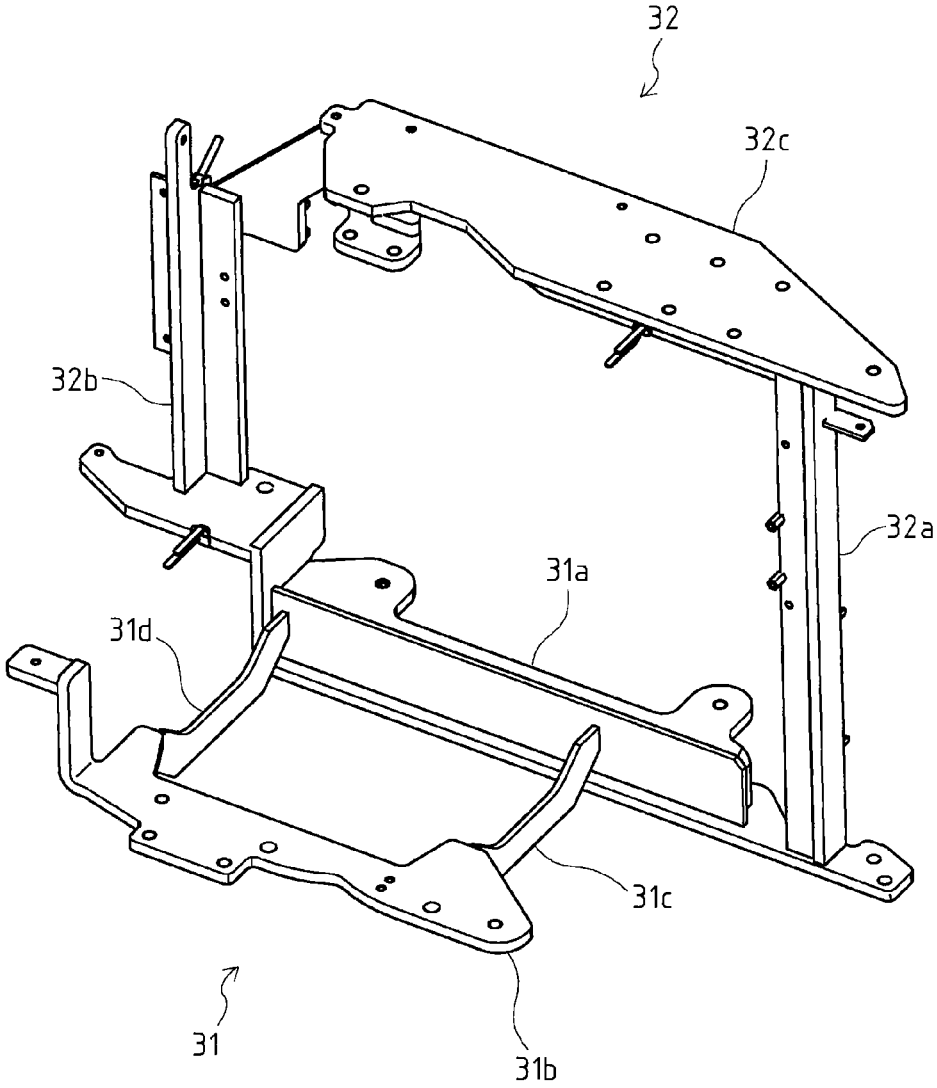
FIG. 9 is a perspective view of an engine supporting member.

As also illustrated in FIG. 9, the engine supporting member 31 includes a rear frame 31*a* and a front frame 31*b*, which are laterally arranged in longitudinally parallel, and frames 31*c* and 31*d*, which are longitudinally arranged in laterally parallel, and the frames 31*a*, 31*b*, 31*c*, and 31*d* are horizontally arranged to form into a frame. The rear frame 31*a* is directly and securely installed on the rotation table frame 5, and the front frame 31*b* is securely installed on the rotation table frame 5 via a bracket 33 that is bent in an inverted U-shape in a side view. Also, the right and left frames 31*c* and 31*d* each of which is configured in a ship-bottom shape in a side view are laterally installed at an appropriate interval between the rear and front frames 31*a* and 31*b*. On the rear and front frames 31*a* and 31*b* of the engine supporting member 31, the engine 8 is supported via a vibration-proof member 34, and on the rear frame 31*a*, the canopy attaching member 32 is further installed upright.

The canopy attaching member 32 includes right and left columnar frames 32*a* and 32*b* and a plate-like canopy attaching plate 32*c*; the right and left frames 32*a* and 32*b* are securely installed on right and left sides of the rear frame 31*a* of the engine supporting member 31 respectively so as to project upward from the right and left sides; and the canopy attaching plate 32*c* is laterally installed between upper end portions of the right and left frames 32*a* and 32*b*. In this manner, the canopy attaching member 32 is formed integrally with the engine supporting member 31, and fixed onto the rotation table frame 5 with bolts or the like, so that it is possible to reduce falling and vibration in the longitudinal direction, as compared with a case where it is securely installed on the rotation table frame 5 by itself. That is, because the heavy engine is placed on the engine supporting member 31, it becomes difficult for the canopy attaching member 32 to fall backward, and forward falling is prevented by support of the engine supporting member 31, so that the canopy attaching member 32 can be stably supported on the rotation table frame 5. Also, the canopy attaching plate 32*c* is arranged rearward of the driver's seat 11 in the driving operation portion 13, and onto the canopy attaching plate 32*c*, the canopy 14 is attached and fixed.

Further, a reinforcing member 35 is coupled between an upper portion of the canopy attaching member 32 and a front portion of the engine supporting member 31 to thereby reinforce the supporting body. That is, the reinforcing member 35 is formed such that a plate is in an inverted L-shape in a side view; arranged so as to surround an upper front portion of the engine 8; coupled to the front frame 31*b* of the engine supporting member 31 at a lower portion of a horizontal portion 35*a* thereof; and coupled to the canopy attaching plate 32*c* of the canopy attaching member 32 at a rear portion of a horizontal portion 35*b* thereof. In this manner, the reinforcing member 35 tightly fixes the canopy attaching member 32 and engine supporting member 31 in a frame shape in a side view.

This allows the canopy attaching member 32 and the engine supporting member 31 to be integrally fixed to the rotation table frame 5, and therefore the canopy attaching member 32 can be tightly fixed and stabilized, as compared with the case where the canopy attaching member 32 is fixed to the rotation table frame 5 by itself. Also, it becomes possible to mount the canopy attaching member 32 and the engine supporting member 31 on the rotation table frame 5 in a state where various instruments are attached onto the canopy attaching member 32 and the engine supporting member 31, so that assemble ability as a module can be improved.

The instruments attachable onto the supporting body integrally including the canopy attaching member 32 and the engine supporting member 31 include a battery 36, an air cleaner 37, a radiator 40, etc. The battery 36 is supported and fixed on a battery placing table 38 attached to the left frame 32*a* of the canopy attaching member 32, and arranged rearward of an upper left portion of the engine 8. The air cleaner 37 is attached onto a bottom face of the canopy attaching plate 32*c* via a stay 39 or the like, and arranged posterosuperior to a laterally middle portion of the engine 8. The radiator 40 is supported on a radiator supporting table 41 attached to right ends of the rear and front frames 31*a* and 31*b* of the engine supporting member 31, and arranged laterally to the right of the engine 8. In addition, the canopy attaching member 32 is attached with a hydraulic hose and harness in addition to the above described instruments to thereby prevent vibration, tangles, and the like.

Also, the reinforcing member 35 is attached with a muffler 42. The muffler 42 is attached via a stay 43 attached to the horizontal portion 35*b* of the reinforcing member 35, and longitudinally arranged above the engine 8. Thus, by configuring the supporting body to be attached with the various instruments, the engine 8 is attached onto the supporting body, and then the various instruments such as the battery 36, the air cleaner 37, the radiator 40, and the muffler 42 are attached to the canopy attaching member 32 and the reinforcing member 35 from the surrounding of the engine longitudinally and laterally, before attaching to the rotation table frame 5, so that it becomes possible to easily move tools and hands closer to the respective components for assembling work, and thereby to surely and easily perform the assembling work.

Figure 7:
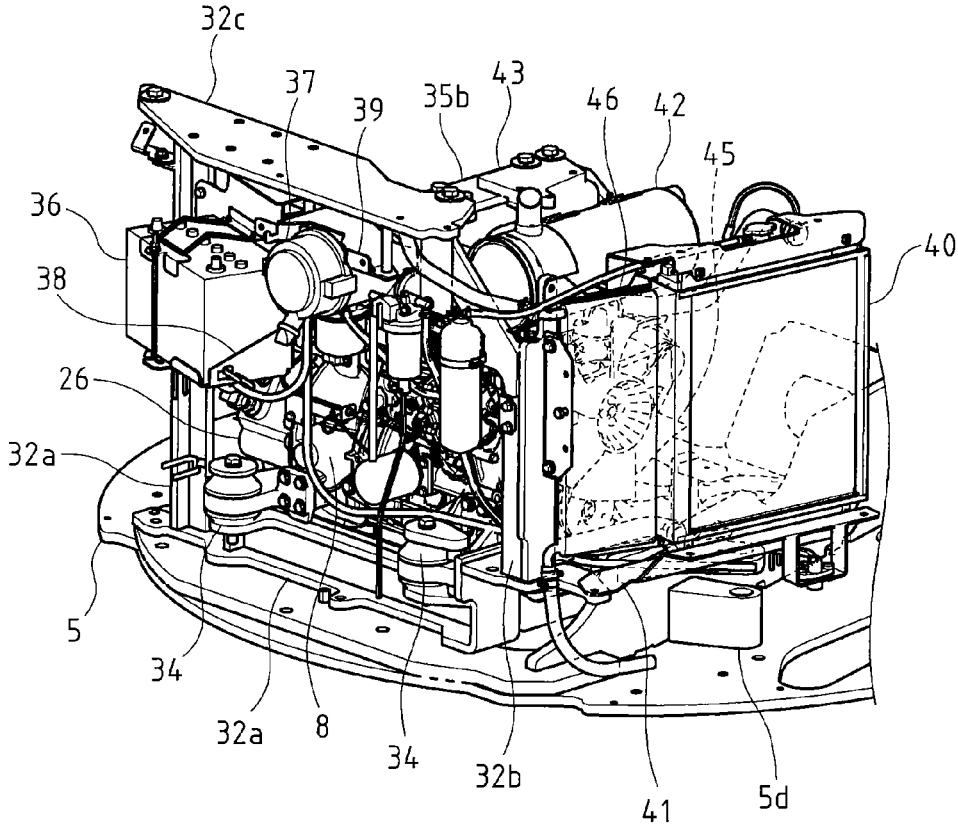
FIG. 7 is a rear perspective view of the engine supporting portion.
Figure 8:
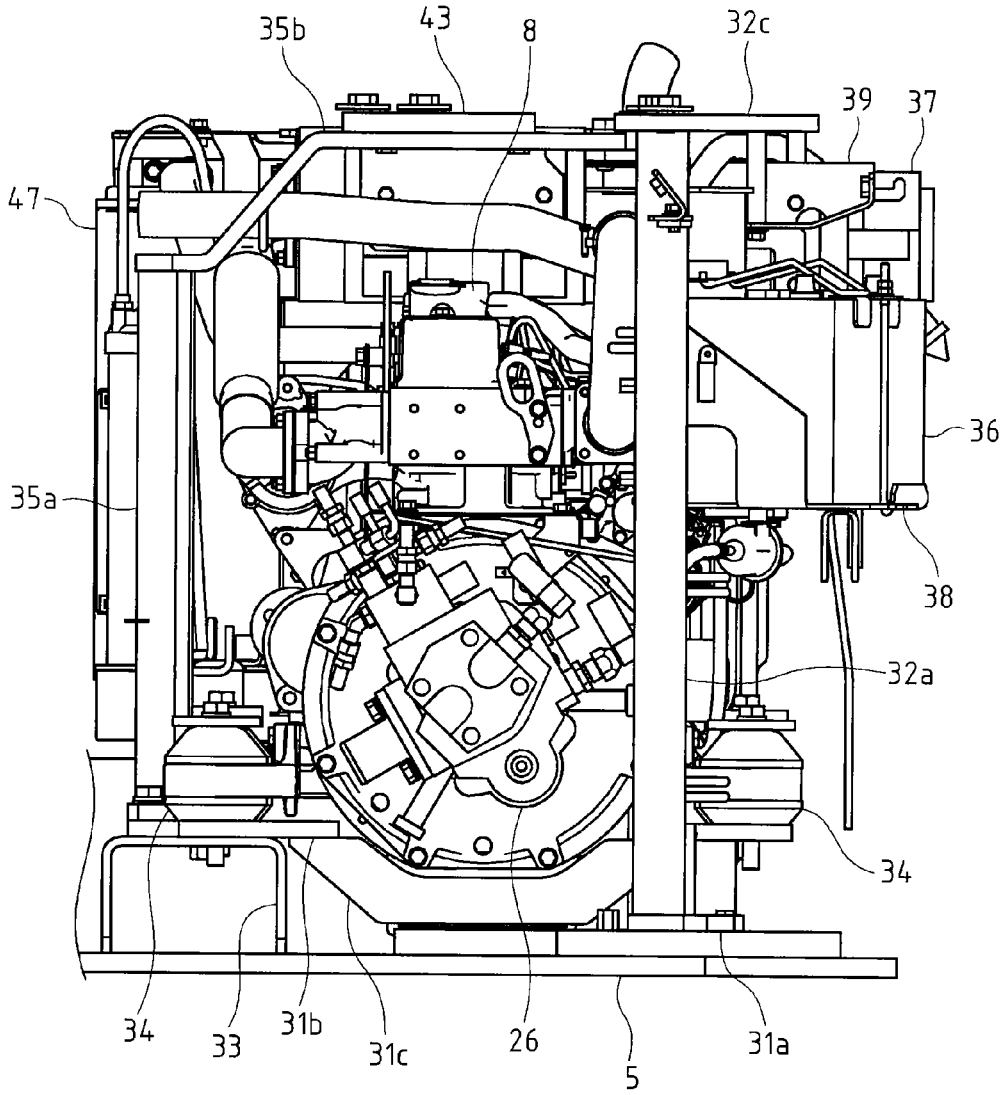
FIG. 8 is a left side view of the engine supporting portion.

The engine 8 supported on the engine supporting member 31 is, as illustrated in FIG. 3, arranged such that a crankshaft is in the lateral direction of the machine body. Right lateral to the engine 8, a cooling fan 45 is provided, and adapted to be drivable by the engine 8 via a belt and pulley. Also, as illustrated in FIG. 7, the radiator 40 and an oil cooler 46 are consecutively installed back and forth right lateral to the cooling fan 45, and arranged such that they do not overlap with each other in a side view and their front end portions face outward. Between the radiator 40 and the oil cooler 46 and the cooling fan 45, a shroud 47 is provided, and in the shroud 47, a space having a substantially triangular shape in a plan view is formed. In this manner, a configuration is made such that cooling wind arising from rotations of the cooling fan 45 passes through the space in the shroud 47, and collides with the radiator 40 and the oil cooler 46 simultaneously to be able to cool them down.

Figure 10:
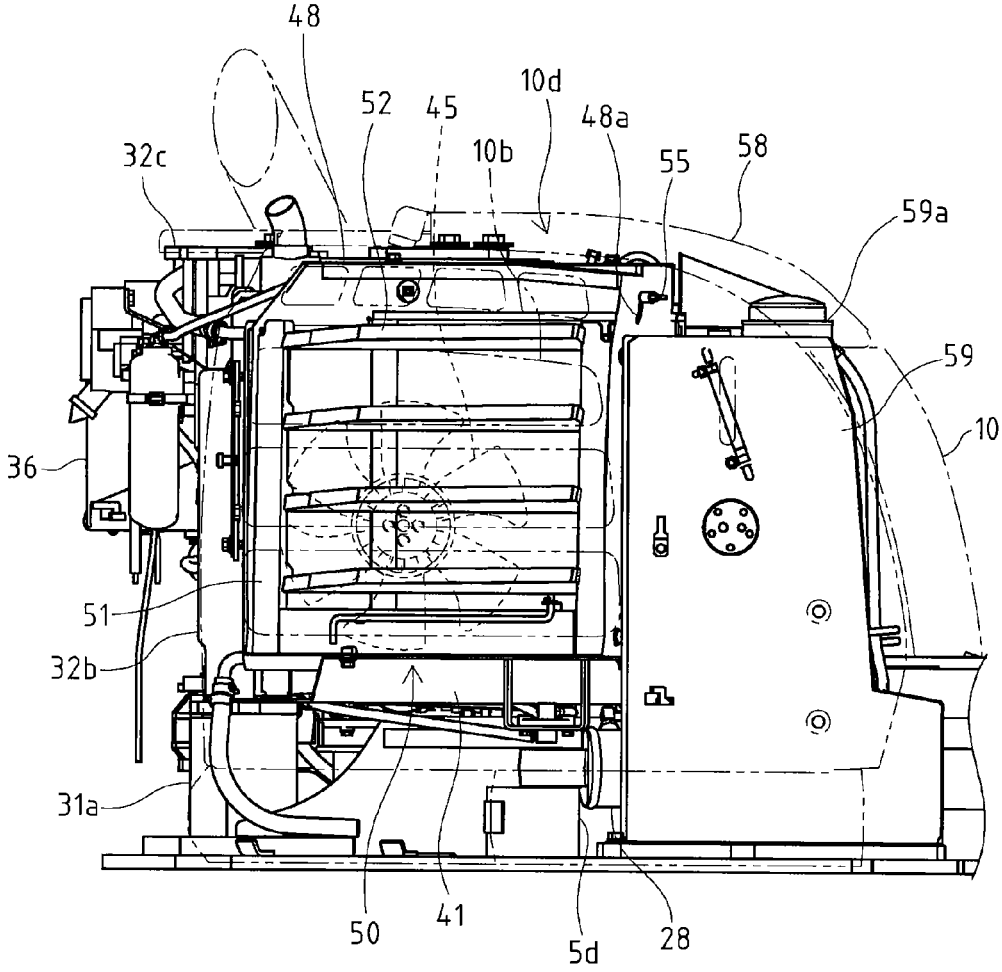
FIG. 10 is a right side view illustrating the configuration on the rotation table frame.

Also, as illustrated in FIGS. 2 and 10, the radiator 40 and the oil cooler 46 are arranged at a predetermined distance from a sidewall of the hood 10 formed in an arc shape, and between the radiator 40 and the oil cooler 46 and the sidewall of the hood 10, a duct 48 is provided. In a portion of a side face of the hood 10, opposite to the radiator 40 and the oil cooler 46, an opening portion 10*b* is provided, through which the duct 48 is communicatively connected to the outside, and thereby the cooling wind from the cooling fan 45 can be discharged outside through the duct 48 and the opening portion 10*b*. In addition, on the opening portion 10*b*, crosspieces 10*c* are laterally placed vertically parallel and also a net-like member is provided, and the crosspieces 10*c* and the net-like member protect the radiator 40 and the oil cooler 46.

Also, a configuration is made such that between the radiator 40 and the oil cooler 46 and the opening portion 10*b* provided on the side face of the hood 10, a movable louver 50 is provided in the duct 48, and when the cooling wind from the cooling fan 45 is discharged outside from the opening portion 10*b*, a direction of the cooling wind can be changed by the louver 50.

Figure 11:
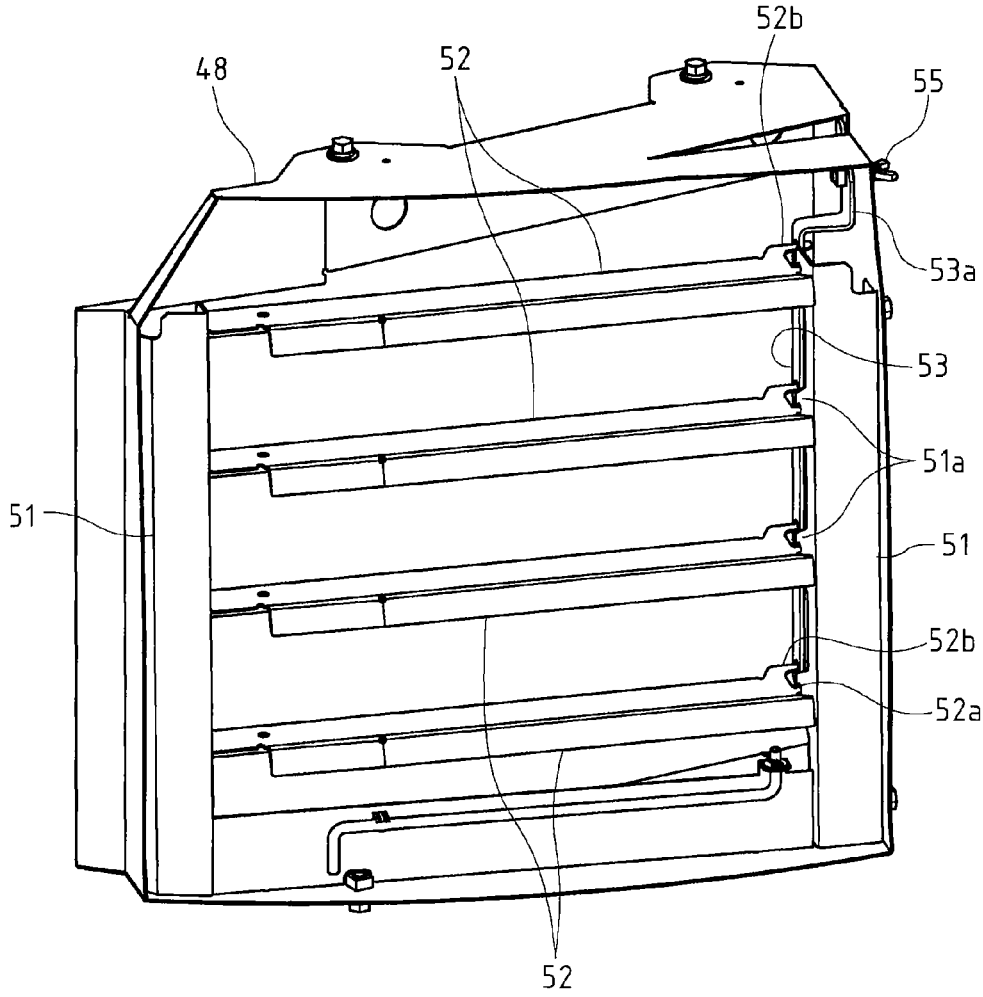
FIG. 11 is a side view of a louver.
Figure 12:
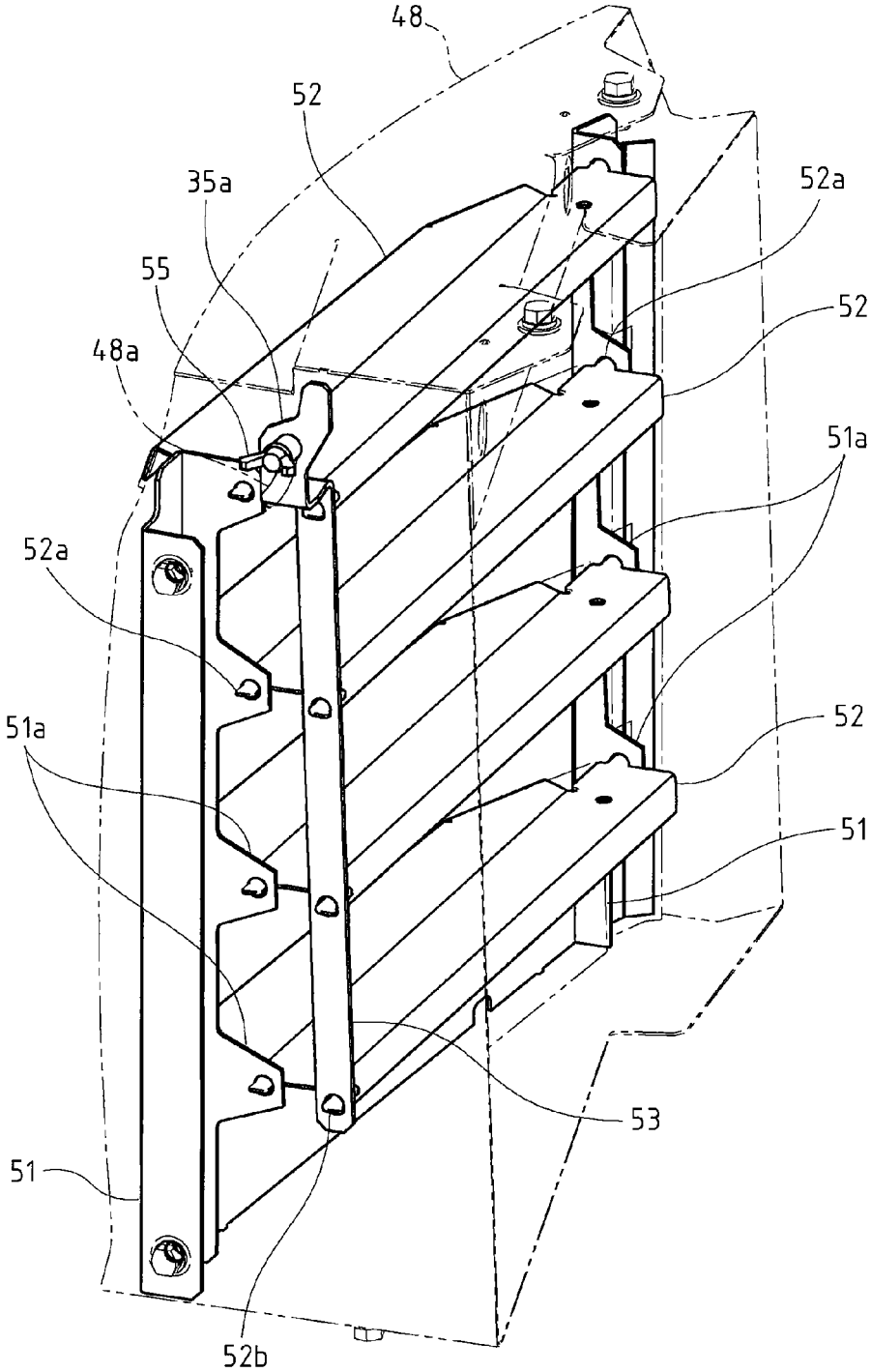
FIG. 12 is a perspective view of the louver.

As illustrated in FIGS. 11 and 12, the louver 50 includes a pair of front and rear side frames 51 securely installed on the sidewall of the duct 48; a plurality of louver boards 52 vertically arranged between the side frames 51; means adapted to change an angle of the louver boards 52; and a position fixing member for the angle. The louver boards 52 are adapted to be laterally placed vertically parallel, and formed such that both ends of shaft portions 52*a* project from both ends that are on the longer sides of and on one of the shorter sides of each of the louver boards 52, toward the side frames 51. The shaft portions 52*a* are pivotally supported by bearing portions 51*a* vertically provided on the right and left side frames 51 at predetermined intervals. In this manner in which both ends of each of the louver boards 52 are supported by the right and left side frames 51 so as to be able to rotationally move, the louver 50 is configured to be movable. The louver board 52 is shaped such that the outside of it is slightly bent in an obliquely upward direction, and a portion of it facing to the oil cooler 46 is narrowed to follow a shape of the sidewall of the hood 10.

Also, a pivotally supporting portion 52*b* is provided in parallel with the shaft portion 52*a* so as to project from one end that is on one of the longer sides of and on the other one of the shorter sides of each of the louver boards 52, and pivotally supported by a lever 53 vertically arranged in parallel with the side frame 51. Thus, the lever 53 is connected to the louver boards 52, and by vertically moving the lever 53, the louver boards 52 are adapted to be able to be rotationally moved in the same direction. Further, an upper portion of the lever 53 is extended upward within the duct 48, and an upper end portion 53*a* of it is bent so as to come into contact with the sidewall of the duct 48. Between the upper portion of the lever 53 and the duct 48, a position fixing member is arranged. That is, a bolt is laterally projected from the upper end portion 53*a* of the lever 53.

Further, an arc-shaped long hole 48*a* is provided on the sidewall of the duct 48 lateral to the upper end portion 53*a* of the lever 53; the bolt is projected outward from the long hole 48*a*; and a butterfly nut 55 is screwed into it and tightened to be thereby able to fix the lever 53 at any operated position. In this manner, the louver 50 is adapted to change the angle of the louver boards 52 to any angle and keep it. However, the fixing means for the lever 53 is not limited to the bolt and nut, but may be a pin or the like, or alternatively may be configured such that any one of the shaft portions 52*a* is connected to a motor by which the angle of the louver boards 52 is changed, or the lever 53 is connected to a cylinder, and the angle of the louver boards 52 is changed by extending or retracting the cylinder. Also, it may be configured to be remotely controlled by controlling means in which an actuator such as the motor or cylinder is provided in a controlling portion.

As described above, the louver 50 is configured to be able to keep the angle of the louver boards 52 at any angle by operating the lever 53 from above the duct 48. Based on this configuration, setting is made such that for example, when the nut 55 is positioned at an upper end of the long hole 48*a* provided on the sidewall of the duct 48 and then tightened to thereby position the lever 53 at the highest position, the louver board 52 can be kept in a state where the outside of the louver board 52 is tilted in an obliquely upward direction, while when the nut 55 is positioned at a lower end of the long hole 48*a* and then tightened to thereby fix the lever at the lowest position, the louver board 52 can be kept in a substantially horizontal state. Also, the nut 55 can be positioned and fixed at any vertical position of the long hole 48*a*.

Accordingly, after cooling wind arising from the rotations of the cooling fan 45 has cooled down the radiator 40 and the oil cooler 46, the cooling wind is discharged from the opening portion 10*b* provided on the hood 10. However, a discharging direction of the cooling wind can be changed in terms of angle to a lateral direction of the main machine or obliquely upward direction depending on the situation. This enables the warmed cooling wind to be prevented from blowing toward trees and pedestrians. For example, if trees are present lateral to the main machine, the cooling wind can be discharged not so as to blow toward the trees by changing the discharging direction of the cooling wind to the obliquely upward direction of the main machine. Also, when the warmed cooling wind is discharged upward, it may blow toward a driver in the driving operation portion 13 depending on an external wind direction. In such a case, by changing the direction of the warmed cooling wind to a substantially horizontal direction, the cooling wind can be laterally discharged to thereby prevent the warmed cooling wind from blowing toward the driver.

Also, the nut 55 for adjusting the angle of the louver 50 is, as illustrated in FIG. 10, arranged below a cover 58 covering a maintenance space 10*d* provided in a front right portion of the hood 10. The cover 58 is configured to be pivotally supported at its rear end by the machine body, and to rotationally move in a vertical direction around the rear end to open or close. Based on this configuration, when the cover 58 is rotationally moved upward to open, the nut 55 is exposed and becomes operatable, and therefore the angle of the louver boards 52 of the louver 50 can be simply and quickly adjusted.

Figure 13:
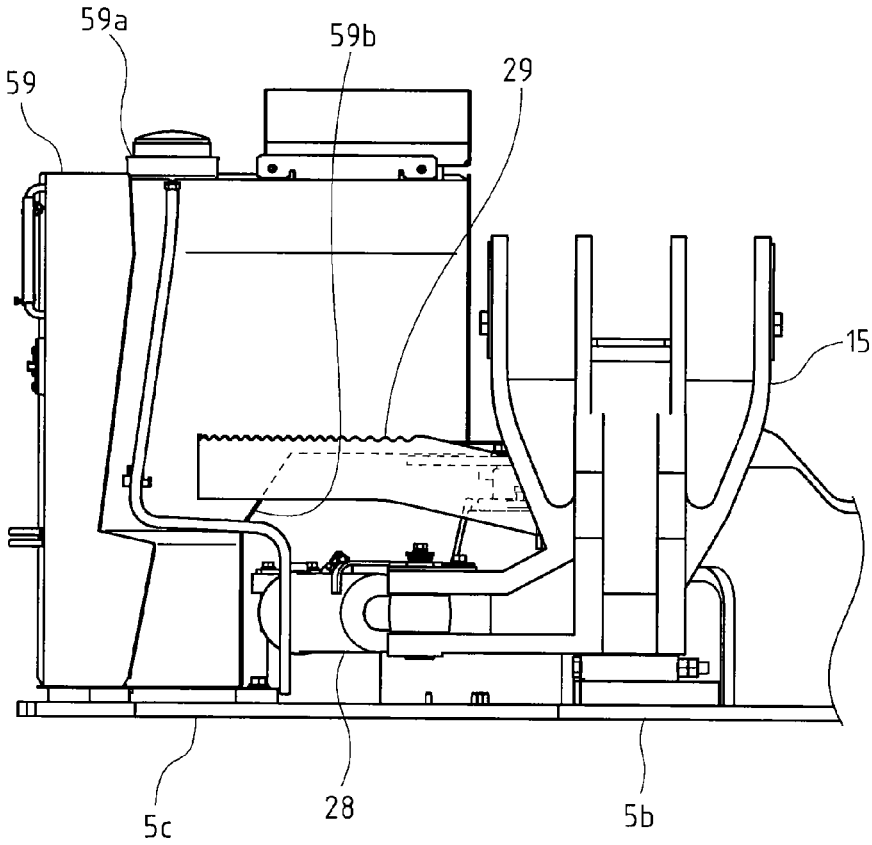
FIG. 13 is an elevation view illustrating a configuration of a front right side on the rotation table frame.

In front of the radiator 40 and the louver 50, a fuel tank 59 is provided. As illustrated in FIGS. 10 and 13, the fuel tank 59 is placed and fixed on the rotation table frame 5, and an upper portion thereof is covered by the cover 58. On an upper face of the fuel tank 59, a fuel filler port 59*a* is provided, from which a fuel can be fed into the fuel tank 59 by rotationally moving and opening the cover 58. On the other hand, a lateral inside of the machine body in a lower portion of the fuel tank 59 is formed so as to be cut off, and in the cutoff portion 59*b*, the swing cylinder 28 is arranged. Based on this, the fuel tank 59 is swelled out at the lower portion laterally to the swing cylinder 28 to increase its capacity as well as being placeable on the laterally same side of the rotation table frame 5 as the swing cylinder 28. However, instead of the fuel tank 59, a reservoir tank may be configured in the same manner and arranged.

Also, a configuration is made such that in front of the fuel tank 59, the second step 29 is arranged, on which a worker rotationally moves the cover 58 to open it, and then can adjust the angle of the louver boards 52 of the louver 50, or feed the fuel into the fuel tank 59 from the fuel filler port 59*a*.

Further, on the side of the engine 8 laterally opposite to the radiator 40, the hydraulic pump 26 is provided and can be driven by the engine 8. As illustrated in FIG. 3, to the left lateral to the hydraulic pump 26, a reservoir tank 61 is provided, and in front of the reservoir tank 61, the control valve 25 is provided. Still further, a configuration is made such that connections between the control valve 25 and the hydraulic pump 26 and the reservoir tank 61, and those between the control valve 25 and the rotation motor 6, the swing cylinder 28, and respective cylinders 20, 21, and 22 in the working machine 1 are made with use of hydraulic hoses, and hydraulic oil is fed from the reservoir tank 61.

Figure 14:
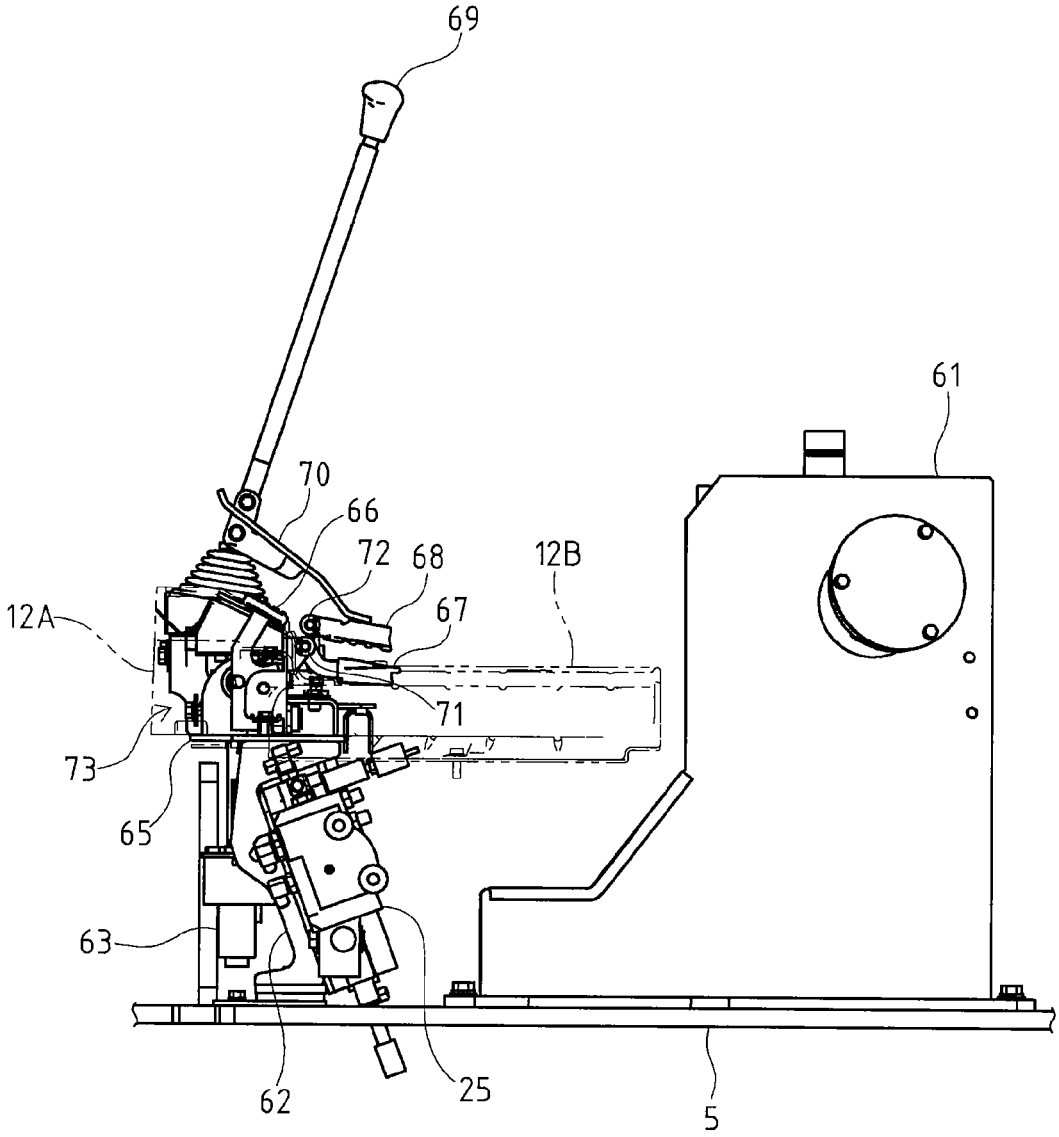
FIG. 14 is a left side view illustrating the configuration on the rotation table frame.
Figure 15:
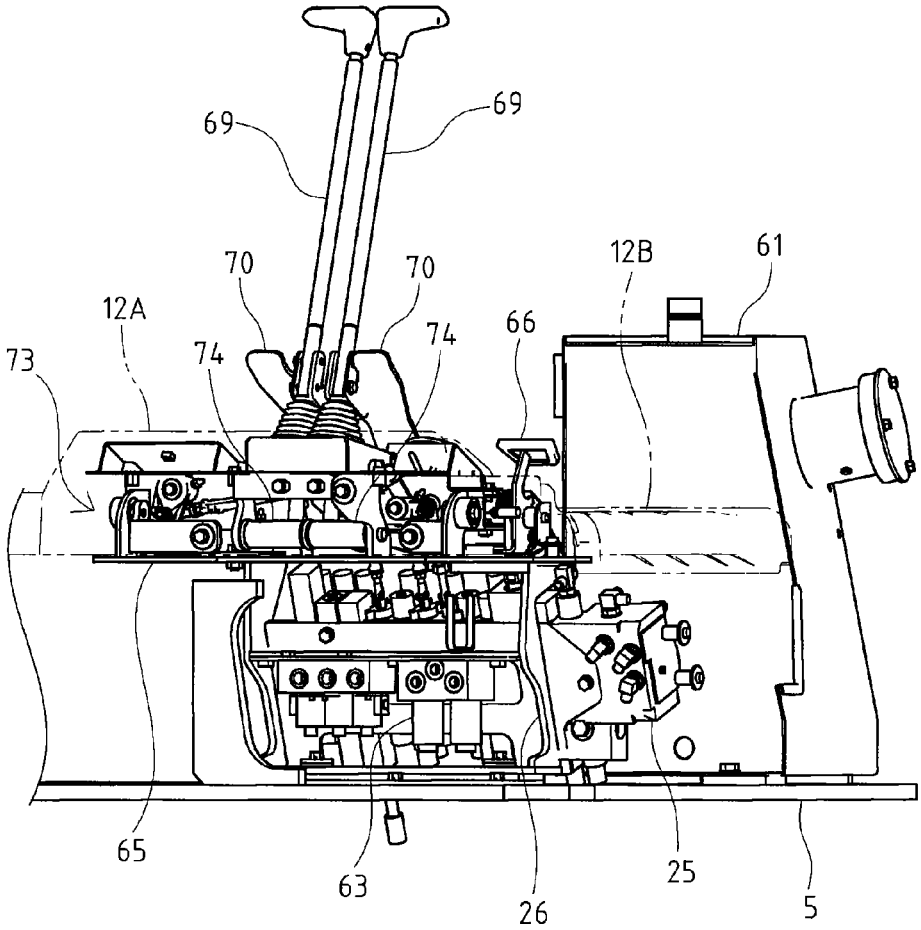
FIG. 15 is a perspective view illustrating a configuration of a front left side on the rotation table frame.

As illustrated in FIGS. 14 and 15, the control valve 25 is placed in front of the reservoir tank 61 and on a left front portion of the rotation table frame 5, and held and fixed with a bracket 62 in a upright state where it is tilted such that its front side position is higher and rear side position lower. By tilting and arranging the control valve 25 as described, the control valve 25 can be arranged on the rotation table frame 5 as forward as possible, and a rear end of the control valve 25 can also be positioned as forward as possible. As a result, a large space can be formed behind it, and therefore it becomes possible to swell out and arrange a front portion of the reservoir tank 61 in the space to thereby increase the capacity of the reservoir tank 61. Also, it becomes possible to arrange an exteriorly removing component 63 for a breaker or the like, which serves as a rear-attached working machine, in a space formed anteroinferior to the control valve 25.

On an upper end of the bracket 62 attaching the control valve 25, a pedal table 65 is provided, above which the step 12 is arranged. The step 12 includes a front step 12A covering the pedal table 65 and a rear step 12B connected to a rear portion of the front step 12A, and is configured to include a plurality of pedals and levers on the front or rear step 12A or 12B. In this embodiment, around a front middle area of the step 12, a travel acceleration pedal 66, a PTO operation pedal 67, and a swing pedal 68 are arranged sequentially from the left, and a pair of right and left operation levers for traveling 69 are provided between the PTO operation pedal 67 and the swing pedal 68 so as to project upward. Further, operation pedals 70 are integrally provided at lower portions of the right and left operation levers 69, respectively, and the operation levers 69 are configured to be operated also with the operation pedals 70.

Figure 16:
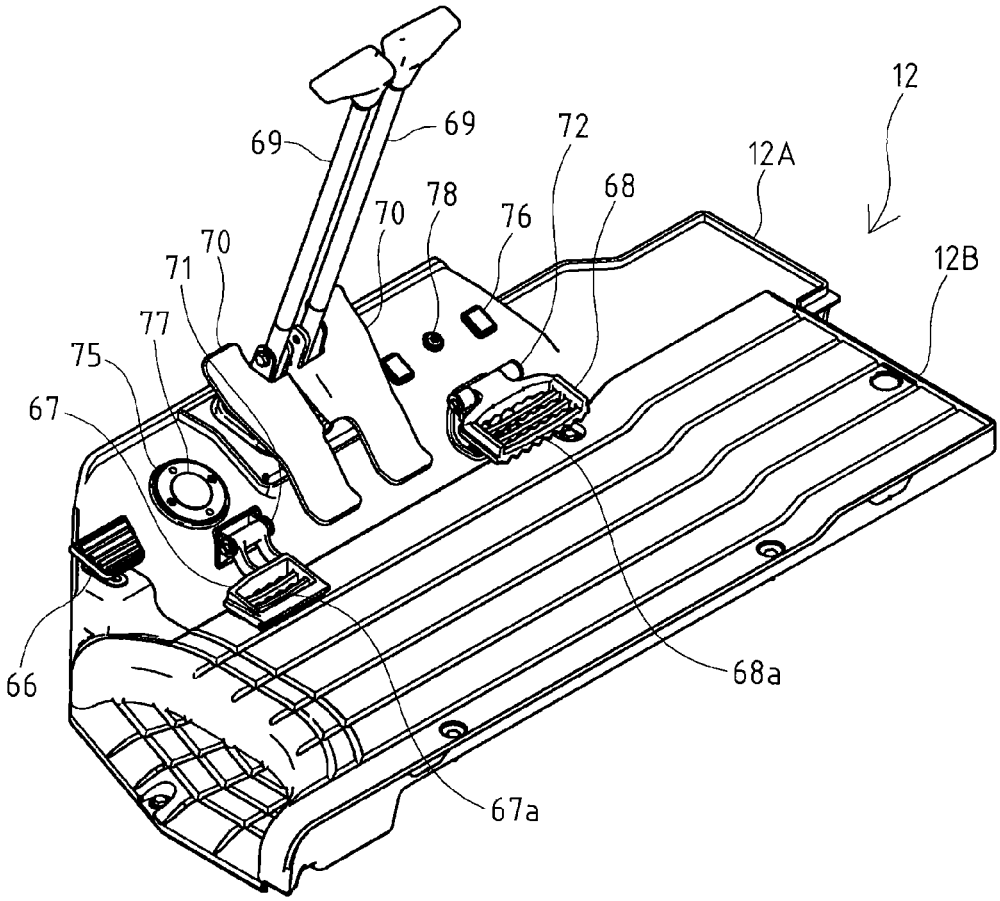
FIG. 16 is a perspective view of the stepped portion in a pedal operating state.
Figure 17:
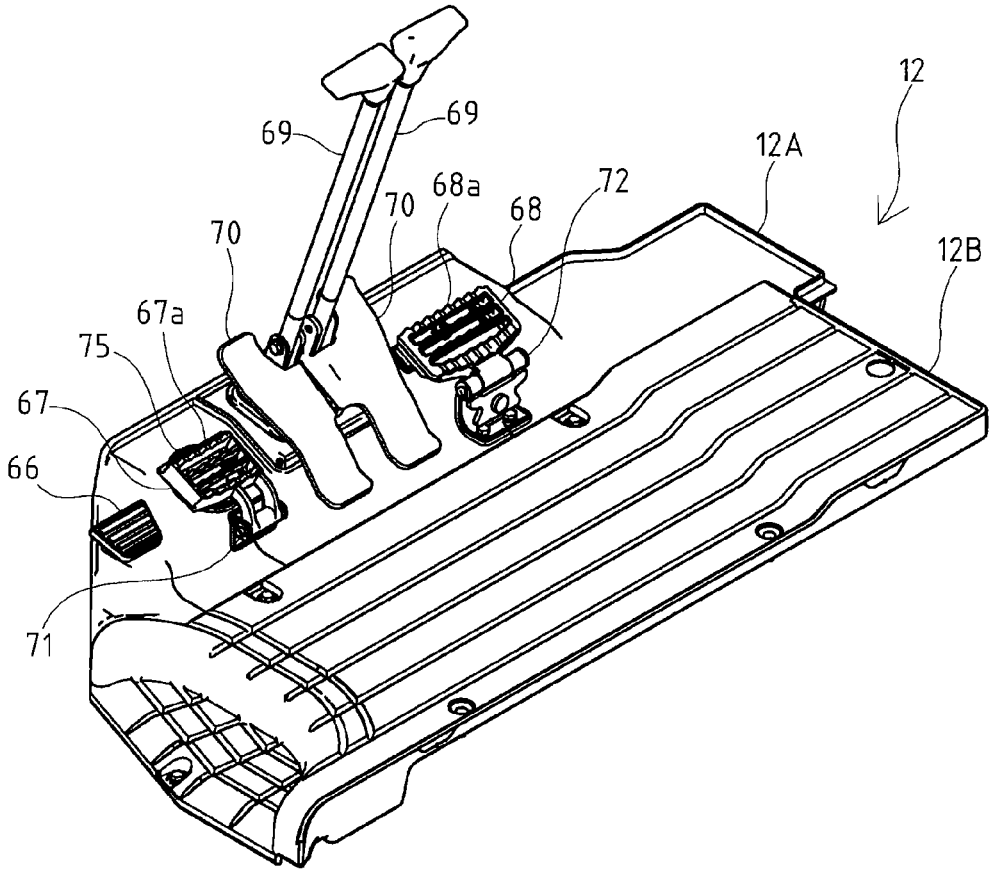
FIG. 17 is a perspective view of the stepped portion in the pedal stored state.
Figure 18:
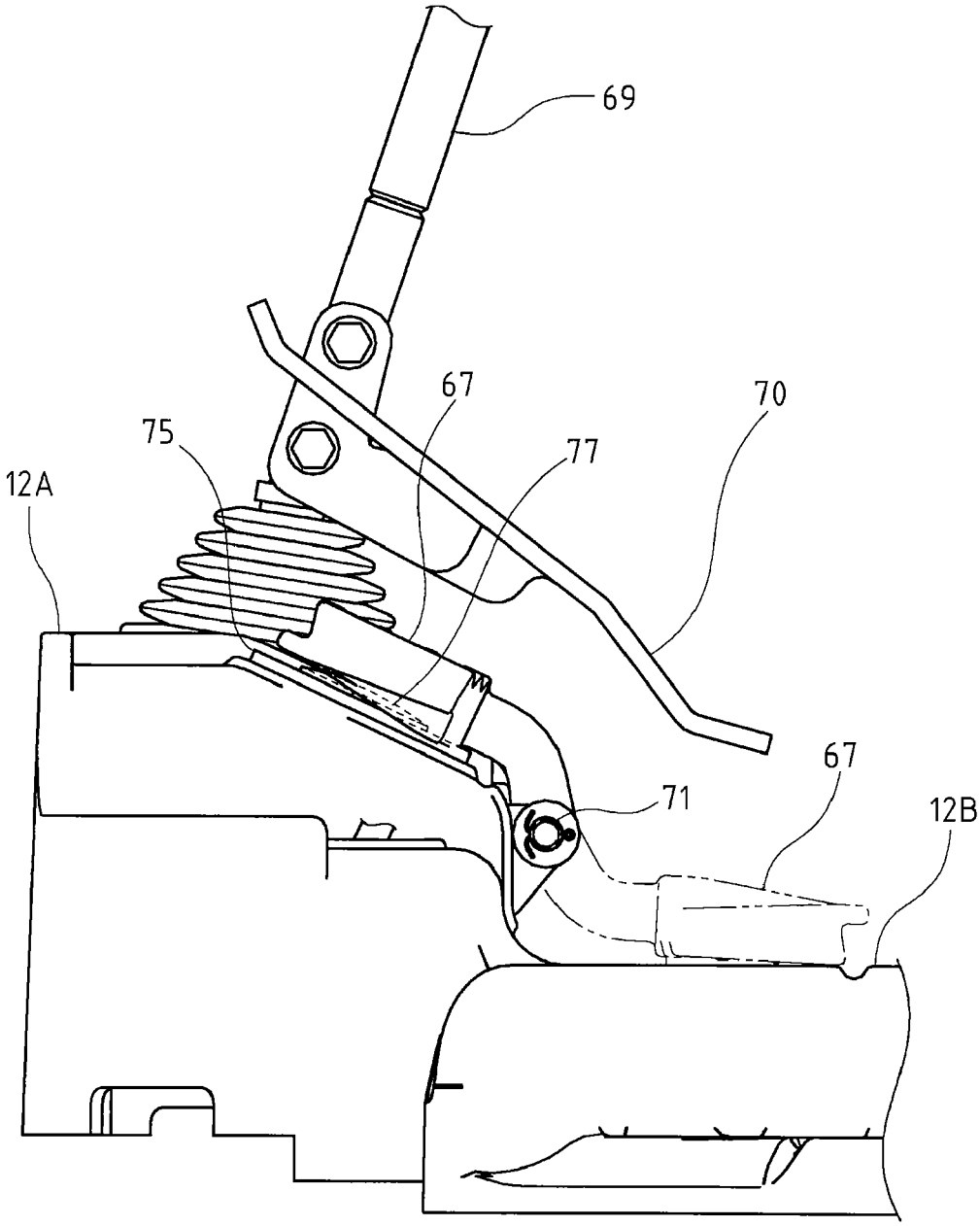
FIG. 18 is a side view of a pedal supporting portion.

As also illustrated in FIGS. 16 to 18, the PTO operation pedal 67 and the swing pedal 68 are supported by the pedal table 65 on one side (front side) so as to be able to rotationally move back and forth around fulcrum shafts 71 and 72, respectively, and connected to the control valve 25 via a link mechanism 73 provided on the pedal table 65. Similarly, the operation levers 69 are supported so as to be able to rotationally move back and forth around fulcrum shafts 74, and connected to the control valve 25 via the link mechanism 73 provided on the pedal table 65. Accordingly, because the control valve 25 is arranged in the tilted state where the front side position thereof is higher and the rear side position is lower as described above, a distance between an upper end of the control valve 25 and the operation lever 69 or the operation pedal 70 can be made shorter as compared with a conventional arrangement in a laid state, and the link mechanism 73 connecting therebetween can be simply configured to reduce cost. Also, it becomes possible to stably perform depressing operations of the operation pedals 70.

Each of the PTO operation pedal 67 and the swing pedal 68 is formed in a substantial L-shape in a side view, and configured such that upper and lower face of one side of the L-shape are provided with footrest portions 67*a* or 68*a*; the other side is pivotally supported by the fulcrum shaft 71 or 72; and switching between an operating state where the depressing operation can be performed with use of rotational movement of the pedal in the longitudinal direction and a stored state (footrest state) where the operation cannot be performed. Also, each of the pedals 67 and 68 is configured to be brought into the operatable state by, as illustrated in FIG. 16, being rotationally moved backward so as to be positioned on the rear step 12B and brought into contact with an operating member of a hydraulic actuator provided in the link mechanism 73, or into the inoperatable stored state, i.e. the footrest state, by, as illustrated in FIG. 17, being rotationally moved forward so as to be positioned on the front step 12A and brought into contact with a receiving member 75 or 76 exposed on the front step 12A.

Further, each of the pedals 67 and 68 is formed so as to sag downward in the middle of the footrest portion 67*a* or 68*a* in the operating state, and configured to rotationally move up and down around the fulcrum shaft 71 or 72 and thereby operate the control valve 25 via the link mechanism 73 when a foot is placed on the footrest portion 67*a* or 68*a* to perform the depressing operation. However, the swing pedal 68 is swung right and left for operation. When the operating state is manually switched to the stored state, and each of the pedals 67 and 68 is rotationally moved forward, the pedal 67 or 68 is brought into contact with the receiving member 75 or 76 at both sides of the pedal 67 or 68 to be thereby held on the front step 12A. At the center of the receiving member 75 or 76, a switch for option 77 or 78 is provided, which is adapted to be covered and protected by the upwardly convex footrest portion 67*a* or 68*a* of the pedal 67 or 68 when the pedal 67 or 68 is brought into the stored state.

Such a configuration enables any erroneous operation to be prevented in such a way that when it is not necessary to operate the PTO operation pedal 67 or the swing pedal 68, the pedal 67 or 68 is rotationally moved forward around the fulcrum shaft 71 or 72 and then brought into contact with the receiving member 75 on the front step 12A to make the depressing operation of the pedal 67 or 68 impossible. At the same time, the switch for option 77 or 78 can be covered by the footrest portion 67*a* or 68*a* of the pedal 67 or 68, so that any erroneous operation of it can also be prevented. Further, the lower face of the footrest portion 67*a* or 68*a* of the pedal 67 or 68 can also be used as a footrest, so that a space around driver's feet on the step 12 can be effectively used.

On the other hand, when it becomes necessary to operate the PTO operation pedal 67 or the swing pedal 68, the pedal 67 or 68 is rotationally moved backward around the fulcrum shaft 71 or 72 and then placed on the rear step 12B to thereby make the depressing operation possible. Accordingly, when the pedal 67 or 68 is unnecessary, the pedal 67 or 68 itself can be rotationally moved forward from the rear step 12B to be simply stored on the front step 12A, so that the space around the driver's feet on the step 12 can be made larger. Also, the pedal 67 or 68 can be held in the inoperable state simply by being rotationally moved forward, so that a conventional pedal cover for making the pedal inoperable becomes unnecessary, and therefore the number of components can be reduced.

Figure 19:
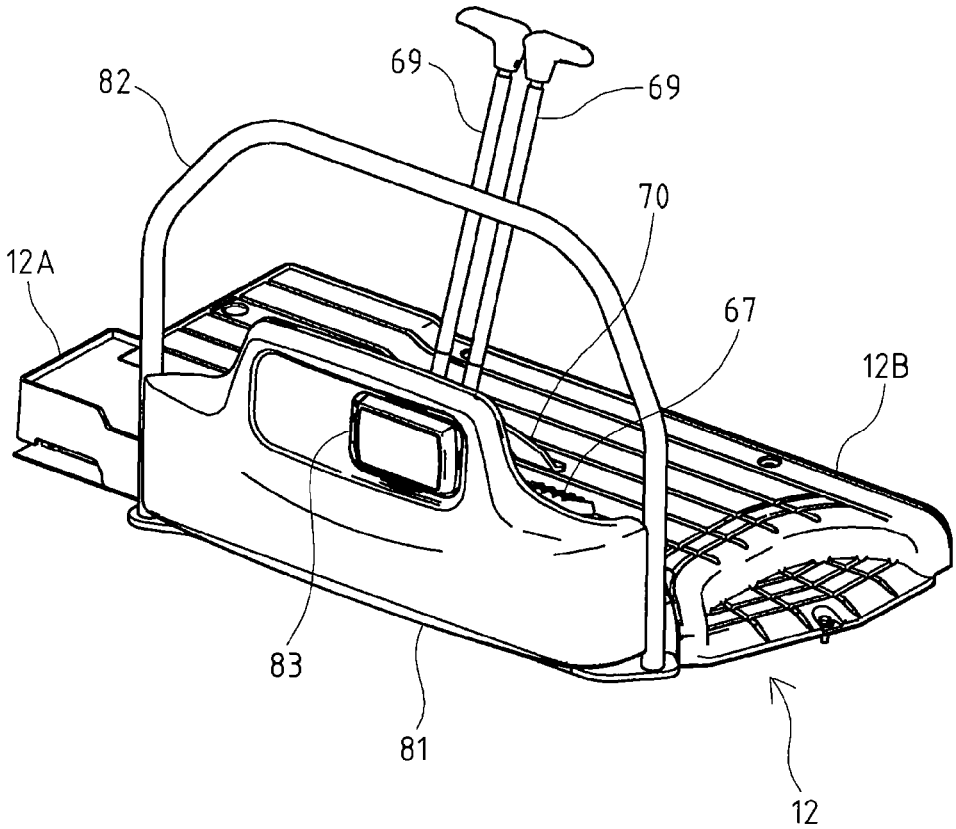
FIG. 19 is a perspective view of a front cover.
Figure 20:
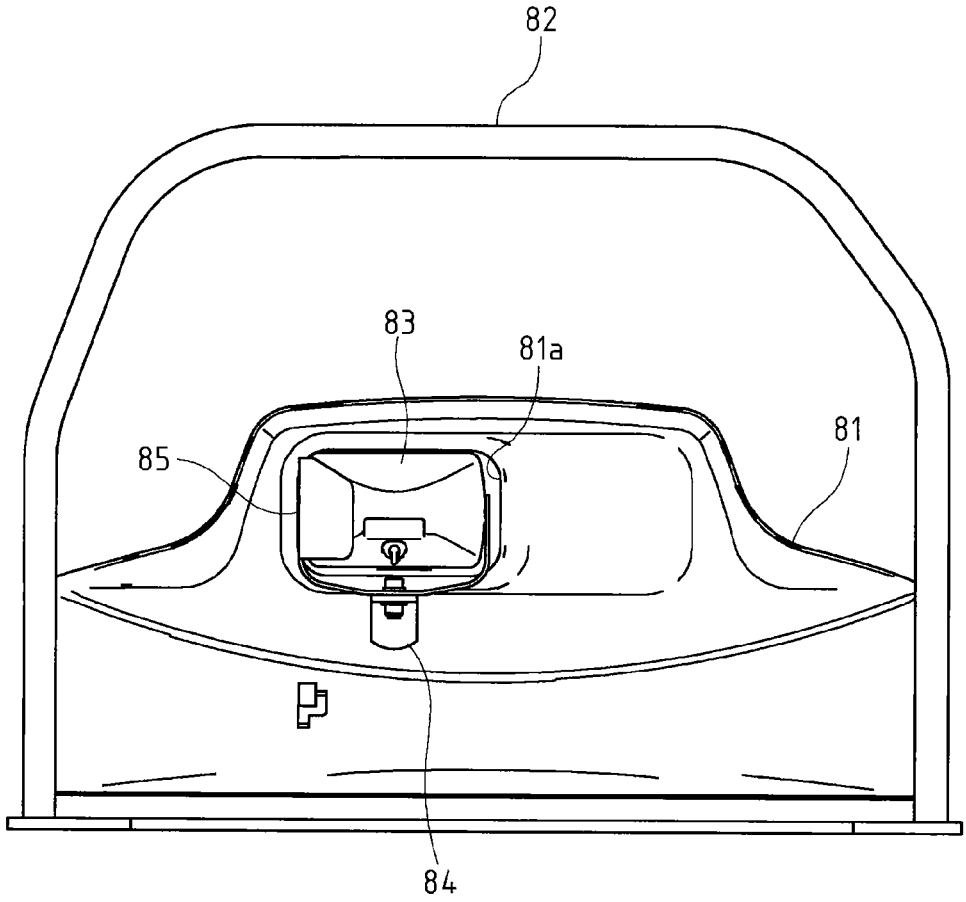
FIG. 20 is a rear view of the front cover.
Figure 21:
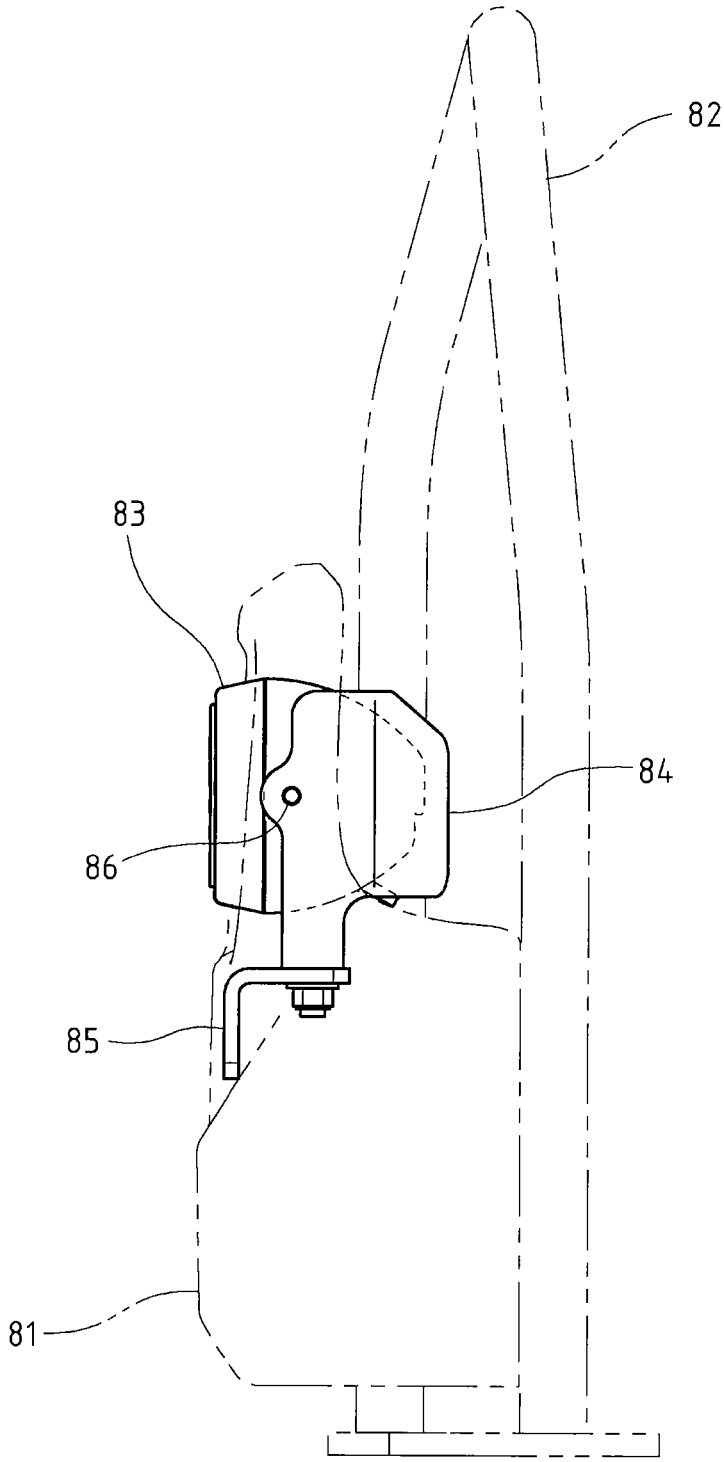
FIG. 21 is a side view illustrating a configuration for supporting a headlight.

As illustrated in FIG. 2, a front cover 81 is arranged in the front end portion of the step 12 so as to cover a space in front of the PTO operation pedal 67, the swing pedal 68, and the like. The front cover 81 is, as illustrated in FIGS. 19 to 21, formed in a convex shape in an elevation view, and laterally placed between both sides of a handrail 82 that is installed upright on the front portion of the step 12 and has a substantially arch-like shape in an elevation view. In an upper central portion of the front cover 81, an opening portion 81*a* is provided, within which a headlight 83 is arranged so as to be positioned as high as possible in front of the driving operation portion 13 in the opening portion 81*a*. Accordingly, the headlight 83 illuminates a space anterior to the driver, so that visibility of the periphery can be improved.

Also, the front cover 81 is arranged such that upper portions of right and left sides thereof are positioned in front of the pedals 67 and 68 provided right and left on the step 12. This enables the driver to bring the driver's legs out from the left outside and right outside of the front cover 81 when the driver stretches the driver's legs anterior to the pedals, and therefore the space around the driver's feet can be made larger.

Figure 22:
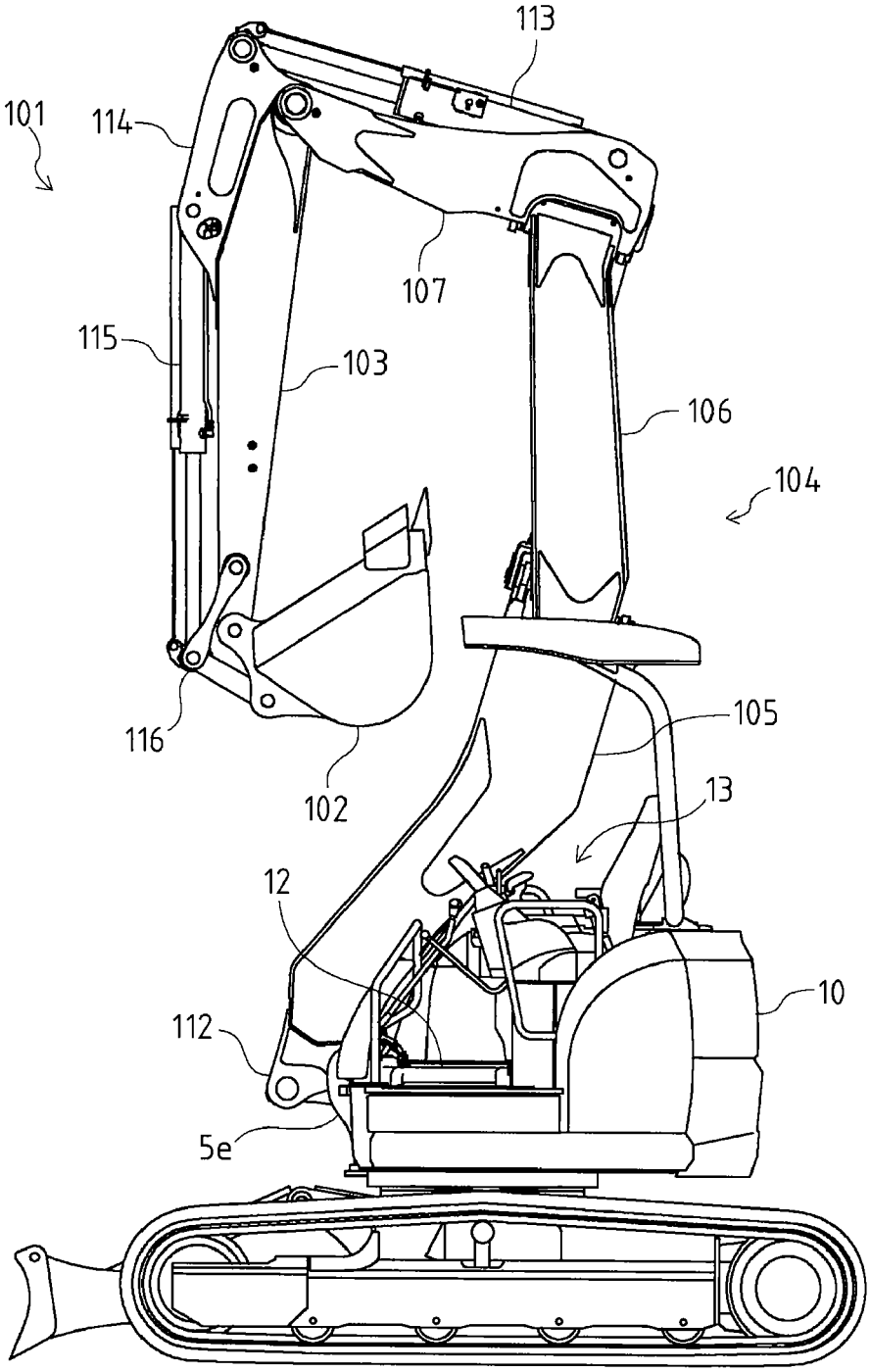
FIG. 22 is a left side view of the swing working vehicle of the type having an extremely small swing radius according to one embodiment of the present invention.

As described above, the rotation table frame 5 including the engine 8, the hydraulic pump 26, the fuel tank, the hydraulic oil tank, the radiator, etc., brings the swing working vehicle to that of the type having an extremely small radius at the rear by being provided with the attaching portion at the lateral center of the laterally linear portion in its front portion and attached with the working machine 1; however, it is configured to also bring the swing working vehicle to that of the type having an extremely small swing radius as illustrated in FIG. 22 by being provided with an attaching portion in the stepped portion 5*c* provided on its front right side and attached with a working machine. That is, the rotation table frame 5 is configured to be usable in common to the swing working vehicles of the type having an extremely small swing radius at the rear and the type having an extremely small swing radius, as a shape common to the vehicles of the both types, except for the front end thereof. Accordingly, a molding die for the rotation table frame 5 can be made common to the swing working vehicles of the type having an extremely small swing radius at the rear and the type having an extremely small swing radius, and therefore productivity can be improved and cost can be reduced.

Figure 23:
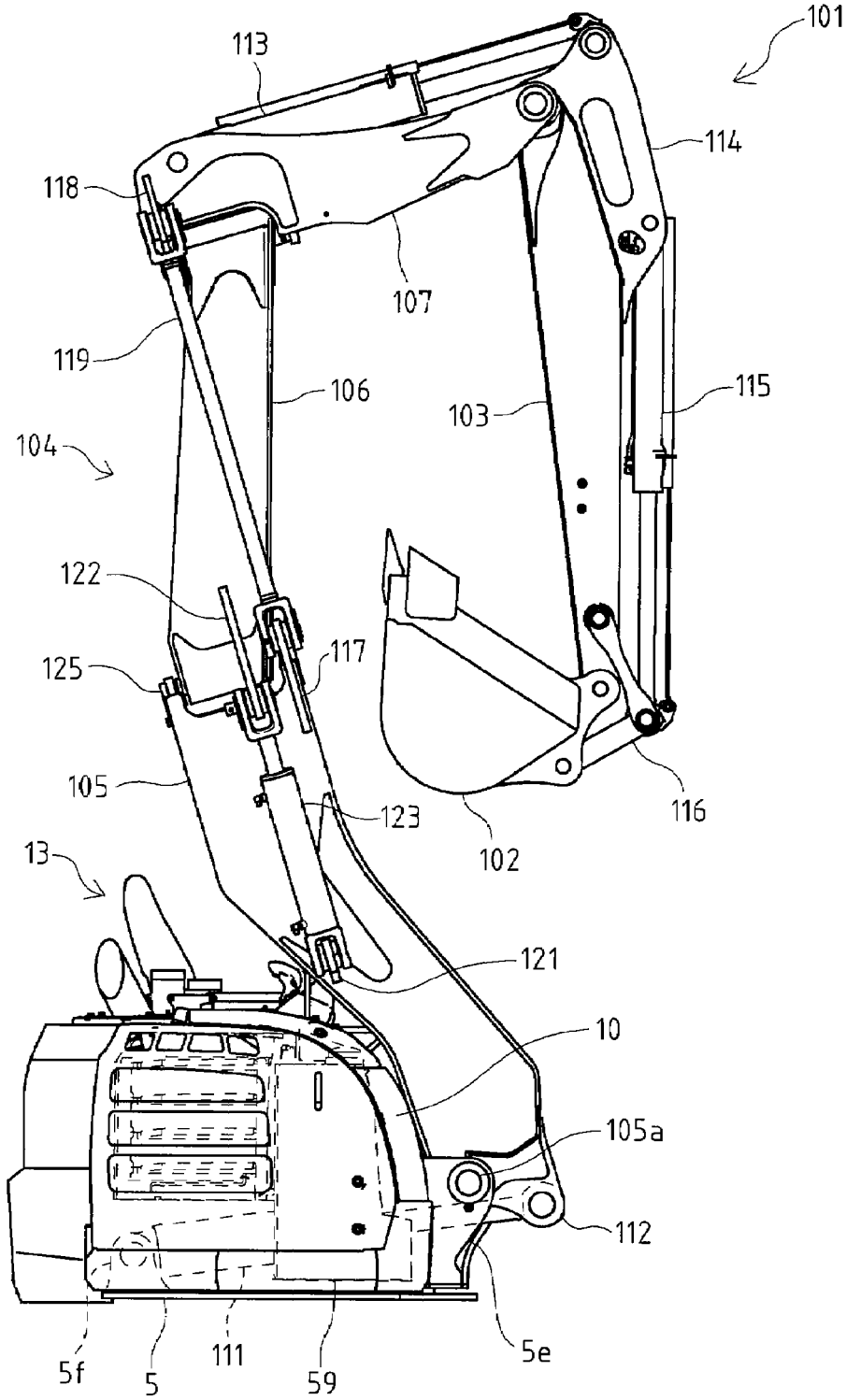
FIG. 23 is a right side view of an upper portion of the swing working vehicle of the type having an extremely small swing radius.
Figure 24:
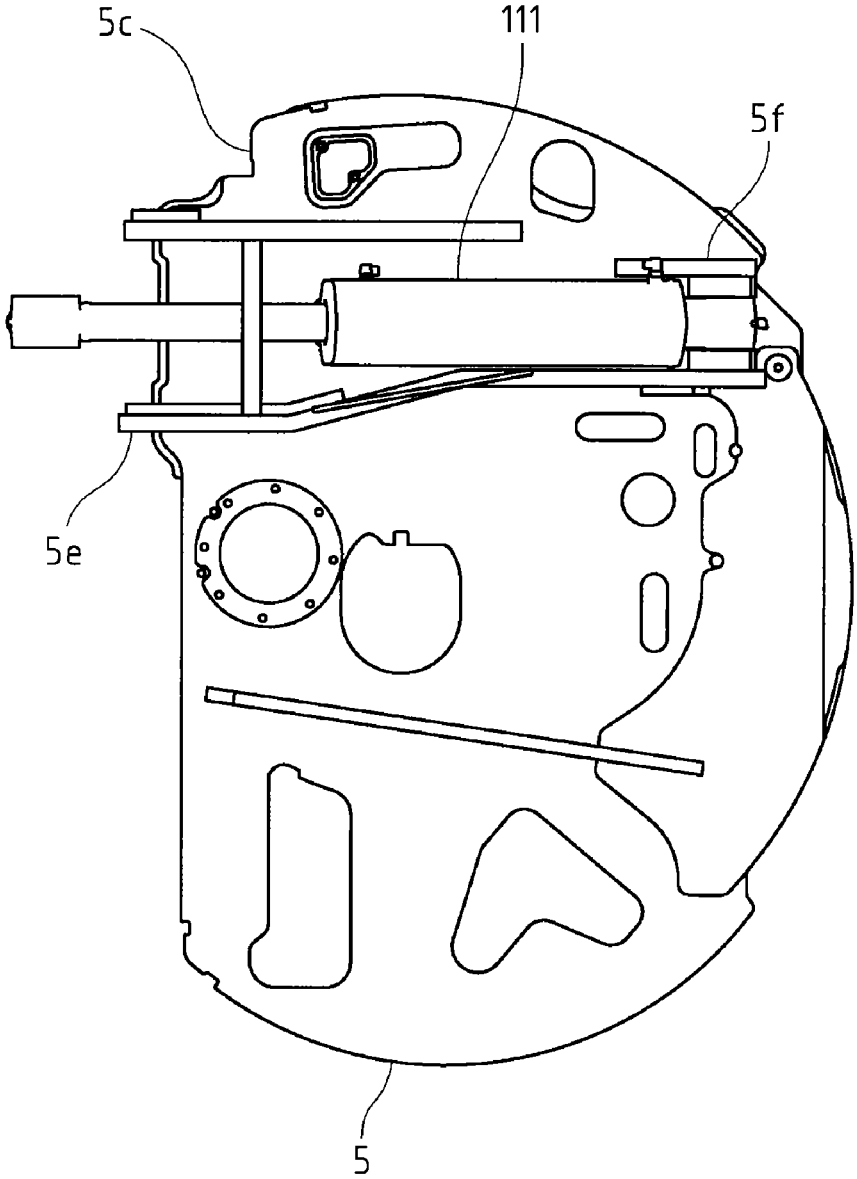
FIG. 24 is a plan view of the rotation table frame.

In the case where the swing working vehicle of the type having an extremely small swing radius is configured with use of the rotation table frame 5, a working machine 101 is pivotally supported by a pivotally supporting portion 5*e* on the stepped portion 5*c* of the rotation table frame 5 such that a fulcrum 105*a* of the working machine 101 is positioned within the swing radius, and arranged rightward on the rotation table frame 5 as illustrated in FIGS. 23 and 24. In this manner, a space within the driving operation portion 13 arranged on the side laterally opposite to the working machine is ensured as large as possible, resulting in an increase in habitability of the driving operation portion 13.

Figure 25:
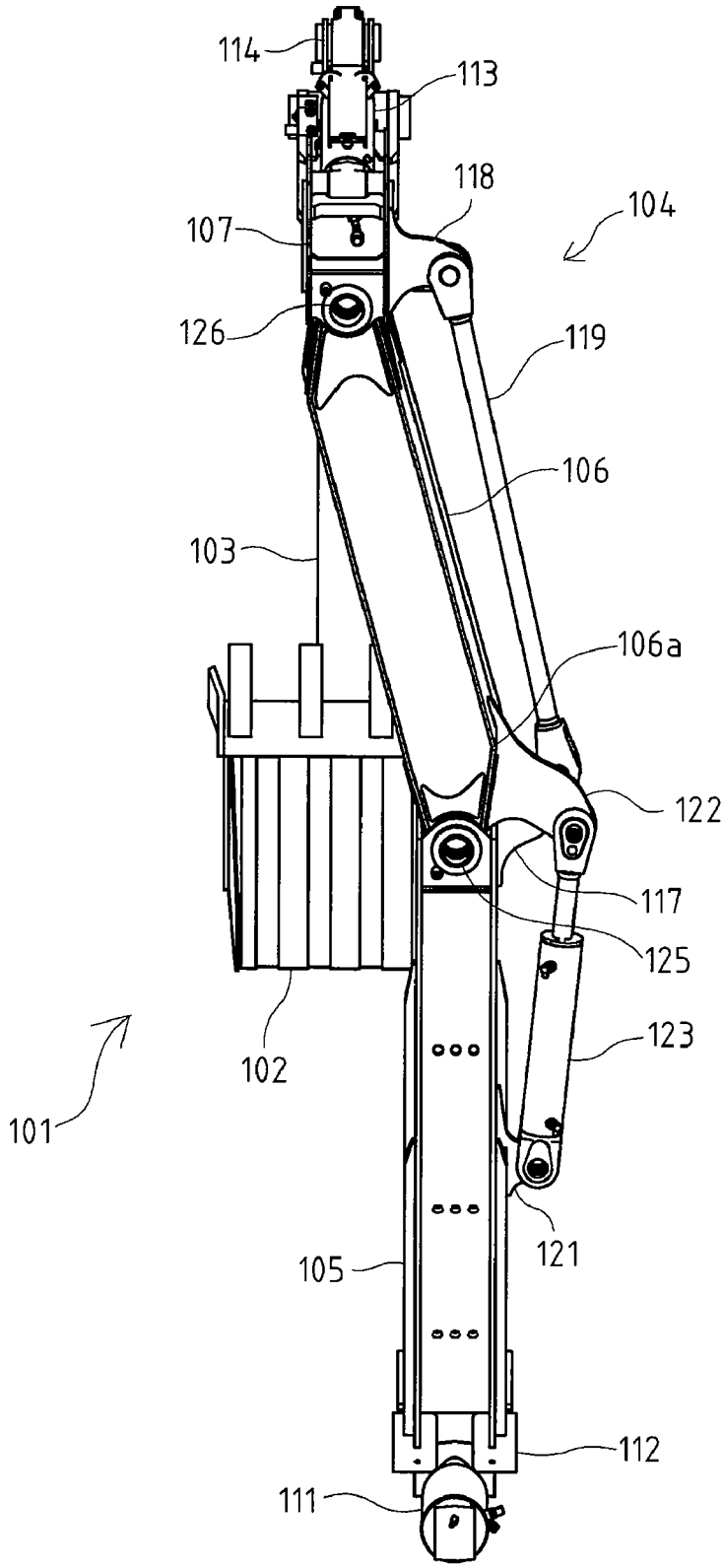
FIG. 25 is a rear view of an offset type working machine.

As illustrated in FIGS. 23 and 25, the working machine 101 includes a bucket 102, an arm 103, and a boom 104, and hydraulic cylinders or the like for actuating them, and is configured as an offset type working machine in which the bucket 102, which is an attachment, can be moved laterally with respect to the boom 104. The boom 104 includes a first boom 105, a second boom 106, and a third boom 107 that are connected sequentially from the main machine side toward the top side, in which a base portion of the first boom 105 is pivotally supported by the pivotally supporting portion 5*e* on the stepped portion 5*c* of the rotation table frame 5 so as to be able to rotationally move up and down (back and forth); a base portion of the second boom 106 is pivotally supported by a top portion of the first boom 105 so as to be able to rotationally move right and left; and a base portion of the third boom 107 is pivotally supported by a top portion of the second boom 106 so as to be able to rotationally move right and left. Also, a base portion of the arm 103 is pivotally supported by a top portion of the boom 104, i.e., a top portion of the third boom 107, so as to be able to rotationally move up and down, and the bucket 102 is pivotally supported by a top portion of the arm 103 so as to be able to rotationally move back and forth.

Further, a boom cylinder 111 for rotationally moving the boom is set between a bracket 112 projected downward from a base portion of the first boom 105 to a position below the fulcrum 105*a* thereof and a pivotally supporting portion 5*f* provided on the rear portion of the rotation table frame 5; an arm cylinder 113 for rotationally moving the arm 103 is set between an arm bracket 114 projected upward to a position above the base portion of the arm 103 and the base portion of the third boom 107; and a bucket cylinder 115 for rotationally moving the bucket is set between a link mechanism 116 for the bucket 102 and the arm bracket 114. In this manner, the boom 104 is adapted to be able to rotationally move by extend/retract driving of the boom cylinder 111; the arm 103 is adapted to be able to rotationally move by extend/retract driving of the arm cylinder 113; and the bucket 102 is adapted to be able to rotationally move by extend/retract driving of the bucket cylinder 115.

Still further, an offset rod 119 is set between a bracket 117 projected on a right side face on the top portion side of the first boom 105 and a bracket 118 projected on a right side face on the base portion side of the third boom 107, and an offset cylinder 123 is set between a bracket 121 projected on a right side face in a middle portion of the first boom 105 and a bracket 122 projected on a right side face on the base portion side of the second boom 106. In this manner, a configuration is made such that the second boom 106 is able to rotationally move right and left by extend/retract driving of the offset cylinder 123; the offset rod 109 is able to rotationally move right and left in conjunction with the rotational movement of the second boom 106; and the third boom 107 and the arm 103 and the bucket 102, which are arranged on the top side of the third boom 107, are able to laterally move in substantially parallel (offset movement) without being tilted right and left in a rear view.

Figure 26:
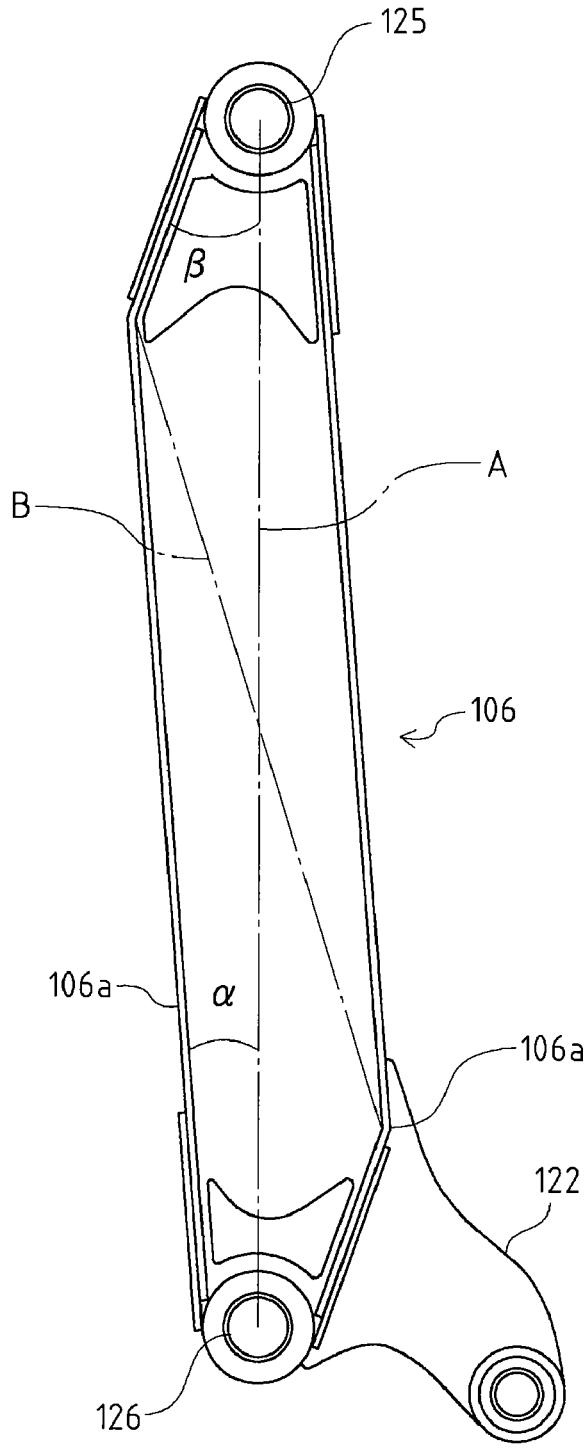
FIG. 26 is a rear view of a second boom.

In this embodiment as illustrated in FIG. 26, in a state where the boom 104 is rotationally moved backward and fixed at a rear most position, a configuration is made such that the second boom 106 is formed in a substantial parallelogram in a rear view; one diagonal A thereof is vertically arranged and the other one B is arranged so as to be tilted toward the lateral middle side of the machine body; and the first and third booms 105 and 107 are pivotally supported by pivotally supporting shafts 125 and 126, respectively, which are provided at both ends of the former diagonal A. In other words, the second boom 106 is configured as the substantial parallelogram such that an angle $\alpha$ between the longitudinal (vertical) diagonal A and a side 106*b* on the base portion side inside the machine body is smaller than an angle $\beta$ between the diagonal A and a side 106*c* on the top side inside the machine body.

This makes a projection inside the base portion of the second boom 106 smaller without reducing stiffness thereof, to thereby make it harder for the second boom 106 to come into contact with the inside of the top portion of the first boom 105, so that it becomes possible to rotationally move the second boom 106 broadly toward the inside of the main machine body. Because an offset amount of the second boom 106 can be increased as described, it becomes possible to arrange the first boom 105 outside the machine body as far as possible, and therefore the space within the driving operation portion 13 can be increased. At this time, a portion 106*a* swelled outward on the base portion side of the second boom 106 is larger in size than that swelled inward at the same vertical position, so that the bracket 122, which is a pivotally supporting portion for a piston rod of the offset cylinder 123 for rotationally moving the second boom 106, can be provided in the portion 106*a* swelled outward on the base portion side of the second boom 106 so as to project further outward, and therefore it becomes possible to rotationally move the second boom 106 broadly toward the inside of the main machine.

Further, the first boom 105 is formed in a substantial S-shape in a side view. The first boom 105 is configured such that when the working machine 101 is brought to the rear most position, and the bucket 102 is rotationally moved so as to get close to the boom 104 via the arm 103, the bucket 102 enters the front space formed on the top portion side, and simultaneously the front portion of the hood 10 enters the rear space formed on the base portion side. This enables the bucket 102 to be positioned on the main machine side as far back as possible without increasing a backward rotational movement angle of the working machine 101, and therefore the swing radius can be reduced.

Also, the boom cylinder 111 for rotationally moving the boom 104 is, as illustrated in FIG. 23, stored in the hood 10 at the back of the stepped portion 5*c* of the rotation table frame 5, and arranged so as to be positioned below the step 12 provided in the driving operation portion 13. In this manner, a wide space is ensured within the hood 10, so that the fuel tank 59 and the reservoir tank 61 to be stored in the space can be increased in terms of capacity, and a space through which the cooling wind flows can be ensured. Also, by arranging the boom cylinder 111 on the main machine side rather than on the working machine 101 side, the working machine 101 is made compact and light in weight.

In the swing working vehicle of the type having an extremely small swing radius, including the offset type working machine 101 as described above, the boom cylinder 111 is arranged on the rotation table frame 5 at the substantially same position as the swing cylinder 28 of the swing working vehicle of the type having an extremely small swing radius at the rear; the fuel tank 59 and the radiator 40 are longitudinally arranged on the rotation table frame 5 above the boom cylinder 111 similarly to the above; and the engine 8 and the reservoir tank 61 are installed together lateral to the radiator 40. Thus, the various instruments are effectively arranged on the rotation table frame 5, and a layout of them is configured to be made common to the swing working vehicles of the type having an extremely small swing radius at the rear and the type having an extremely small swing radius.

INDUSTRIAL APPLICABILITY

The swing working vehicle according to the present invention is industrially useful because the rotation table frame that is rotatably supported on the traveling device and includes the working machine is made common to the swing working vehicles of the type having an extremely small swing radius at the rear and the type having an extremely small swing radius, and as a result, productivity is increased and costs are reduced.

The invention claimed is:

1. A swing working vehicle, comprising:

a rotation table frame formed in a circular shape in a plan view from both side portions to a rear end, wherein the rotation table frame includes a left front end and a right front end, which are extended laterally of the body frame and have a step therebetween when viewed in plan so that the right front end is disposed rearward from the left front end;

a hydraulic cylinder supported at a rear end thereof on the rotation table frame rearward from the right front end;

a fuel tank and a radiator which are mounted on the rotation table above the hydraulic cylinder; and an engine and a reservoir tank which are mounted on the rotation table laterally from the radiator.

2. The swing working vehicle according to claim 1, wherein a boom fulcrum is arranged between the left and right front ends of the rotation table frame, and a floor member is arranged to cover a space in front of the right front end of the rotation table frame formed by the step swing radius.

* * * * *